US009010745B2

(12) United States Patent
Fukuda

(10) Patent No.: US 9,010,745 B2
(45) Date of Patent: Apr. 21, 2015

(54) SHEET PROCESSING APPARATUS AND METHOD OF CONTROLLING THE SAME, AND STORAGE MEDIUM

(71) Applicant: Canon Kabushiki Kaisha, Tokyo (JP)

(72) Inventor: Shin Fukuda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/055,423

(22) Filed: Oct. 16, 2013

(65) Prior Publication Data

US 2014/0125001 A1 May 8, 2014

(30) Foreign Application Priority Data

Nov. 6, 2012 (JP) ..... 2012-244806

(51) Int. Cl.

| | |
|---|---|
| ***B65H 33/04*** | (2006.01) |
| ***B65H 31/10*** | (2006.01) |
| ***B65H 31/20*** | (2006.01) |
| ***B65H 31/24*** | (2006.01) |
| ***B65H 31/38*** | (2006.01) |
| ***B65H 33/08*** | (2006.01) |
| ***B65H 39/10*** | (2006.01) |
| ***G03G 15/00*** | (2006.01) |
| ***G03G 21/02*** | (2006.01) |

(52) U.S. Cl.

CPC ..... *B65H 33/04* (2013.01); *B65H 31/10* (2013.01); *B65H 31/20* (2013.01); *B65H 31/24* (2013.01); *B65H 31/38* (2013.01); *B65H 33/08* (2013.01); *B65H 39/10* (2013.01); *G03G 15/655* (2013.01); *G03G 21/02* (2013.01); *B65H 2301/4263* (2013.01); *B65H 2405/332* (2013.01); *B65H 2511/12* (2013.01); *B65H 2511/30* (2013.01); *B65H 2511/414* (2013.01); *B65H 2511/51* (2013.01); *B65H 2511/516* (2013.01); *B65H 2513/512* (2013.01); *B65H 2601/251* (2013.01); *B65H 2701/18264* (2013.01); *B65H 2801/27* (2013.01); *G03G 2215/00911* (2013.01)

(58) Field of Classification Search

USPC ..... 270/58.07, 58.11, 58.12, 58.16, 58.17, 270/58.27, 58.31, 58.32; 271/221, 223, 224

See application file for complete search history.

(56) References Cited

U.S. PATENT DOCUMENTS

| | | | | |
|---|---|---|---|---|
| 5,316,279 | A * | 5/1994 | Corona et al. | 270/1.01 |
| 5,848,346 | A * | 12/1998 | Takashiro | 399/404 |
| 6,227,531 | B1 * | 5/2001 | Guerrero et al. | 270/58.31 |
| 7,681,881 | B2 * | 3/2010 | Kunieda et al. | 271/221 |
| 8,251,362 | B2 * | 8/2012 | Konishi | 270/58.17 |

FOREIGN PATENT DOCUMENTS

| | | |
|---|---|---|
| JP | 2006-206331 A | 8/2006 |

* cited by examiner

*Primary Examiner* — Leslie A Nicholson, III

(74) *Attorney, Agent, or Firm* — Cowan, Liebowitz & Latman, P.C.

(57) ABSTRACT

A sheet processing apparatus and a method of controlling the same align sheets stacked on a stacking unit, by causing a first alignment member and a second alignment member to come into contact with edges of a sheet stacked on the stacking unit in a sheet width direction. In a case that a second sheet that is different from a first sheet stacked on the stacking unit is to be stacked on the first sheet and aligned using the first alignment member and the second alignment member, control is performed to discharge a partition sheet onto the first sheet stacked on the stacking unit.

11 Claims, 24 Drawing Sheets

DEFAULT POSITIONS OF ALIGNMENT PLATES

WAITING POSITIONS OF ALIGNMENT PLATES

ALIGNING POSITIONS OF ALIGNMENT PLATES

EVACUATED POSITIONS OF ALIGNMENT PLATES

POSITIONS OF ALIGNMENT PLATES WHEN ALIGNMENT IS FINISHED

POSITIONS OF ALIGNMENT PLATES THAT HAVE BEEN RAISED OFF TRAY

POSITIONS OF ALIGNMENT PLATES FOR ACCEPTING NEXT SHEET

POSITIONS OF ALIGNMENT PLATES COMING INTO CONTACT WITH ALREADY-STACKED SHEETS

POSITIONS OF ALIGNMENT PLATES WHEN SHEET IS DISCHARGED

POSITIONS OF ALIGNMENT PLATES WHEN EXECUTING ALIGNMENT

ALIGNMENT WAITING POSITIONS OF ALIGNMENT PLATES

APPLIED MODE SELECTION SCREEN

SIZE-MIXED STACK SCREEN

SHEET PROCESSING APPARATUS AND METHOD OF CONTROLLING THE SAME, AND STORAGE MEDIUM

BACKGROUND OF THE INVENTION

1. Field of the Invention

The present invention relates to a sheet processing apparatus that has a function of aligning sheets stacked on a receiving tray, a method of controlling the same, and a storage medium.

2. Description of the Related Art

For sheet stackers that stack printed sheets discharged from a printing apparatus on a tray, there has been demand for the ability to align the sheets on the tray with a high degree of accuracy. Japanese Patent Laid-Open No. 2006-206331 suggests a technique to align sheets stacked on a receiving tray. According to this technique, alignment members are provided on the receiving tray, and the positions of edge surfaces of the sheets parallel to a sheet discharge direction are aligned by the alignment members coming into and out of contact with the edge surfaces of the sheets.

Now, assume the case where, as shown in FIG. 21, sheets having a sheet width W2 are to be stacked and aligned on sheets that have a different sheet width W1 and are already stacked on a receiving tray 2101 (W2<W1). In this case, in order to align the sheets having the sheet width W2, it is necessary to cause alignment plates A and B to come into contact with a top surface of the already-stacked sheets. When sheet alignment operations are executed by moving the alignment plate A in the direction of an arrow shown in FIG. 21 while the alignment plates A and B are thus in contact with the top surface of the already-stacked sheets, the bottom surface of the alignment plate A is slid against the front surface of the top sheet of the already-stacked sheets. This can lead to the possibility that the toner printed on the topmost sheet of the already-stacked sheets is removed and the quality of an image on the topmost sheet is degraded.

There is also a possibility that the removed toner is attached to and stains the bottom surface of the alignment plate A, and the attached toner stains other sheets when the bottom surface of the alignment plate A comes into contact with other sheets. Upon printing sheets that have a different width from sheets that are already printed and stacked, the printing may be interrupted first to allow a user to remove the sheets that are already printed and stacked from the receiving tray, and then the printing may be resumed for the sheets that have a different width. Although this method does not give rise to the aforementioned problem, it is still problematic in that it reduces the productivity of printing.

SUMMARY OF THE INVENTION

An aspect of the present invention is to eliminate the above-mentioned problems with the conventional technology.

A feature of the present invention is to provide a technique to, even when a sheet that has a different width from a stacked sheet is to be stacked on the stacked sheets, align sheets without interrupting a print process and without staining the stacked sheet.

According to an aspect of the present invention, there is provided a sheet processing apparatus comprising: a discharge control unit configured to control to discharge a sheet on a stacking unit; an alignment unit configured to align sheets stacked on the stacking unit by causing a first alignment member and a second alignment member to come into contact with edges of a sheet stacked on the stacking unit in a sheet width direction; and a control unit configured to perform control to, in a case that a second sheet that is different from a first sheet stacked on the stacking unit is to be stacked on the first sheet and aligned by the alignment unit, separate between the first sheet and the second sheet by discharging a partition sheet onto the first sheet stacked on the stacking unit.

According to an aspect of the present invention, there is provided a method of controlling a sheet processing apparatus, comprising: controlling to discharge a sheet on a stacking unit; aligning sheets stacked on the stacking unit by causing a first alignment member and a second alignment member to come into contact with edges of a sheet stacked on the stacking unit in a sheet width direction; and performing control to, in a case that a second sheet that is different from a first sheet stacked on the stacking unit is to be stacked on the first sheet and aligned, discharge a partition sheet onto the first sheet stacked on the stacking unit.

According to an aspect of the present invention, there is provided a sheet processing apparatus comprising: a discharge control unit to control to discharge a sheet on a stacking unit; an alignment unit configured to align sheets stacked on the stacking unit by causing a first alignment member and a second alignment member to come into contact with edges of a sheet stacked on the stacking unit in a sheet width direction; and a control unit configured to perform control to the alignment unit to align sheets stacked on the stacking unit even if a second sheet that is different from a first sheet stacked on the stacking unit is to be stacked on the first sheet.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Embodiments of the present invention will be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. It should be noted that a sheet processing apparatus according to the present invention may be included in a later-described image forming apparatus, may be included in a sheet stacker, or may constitute an image forming apparatus or a sheet stacker.

Figure 1:
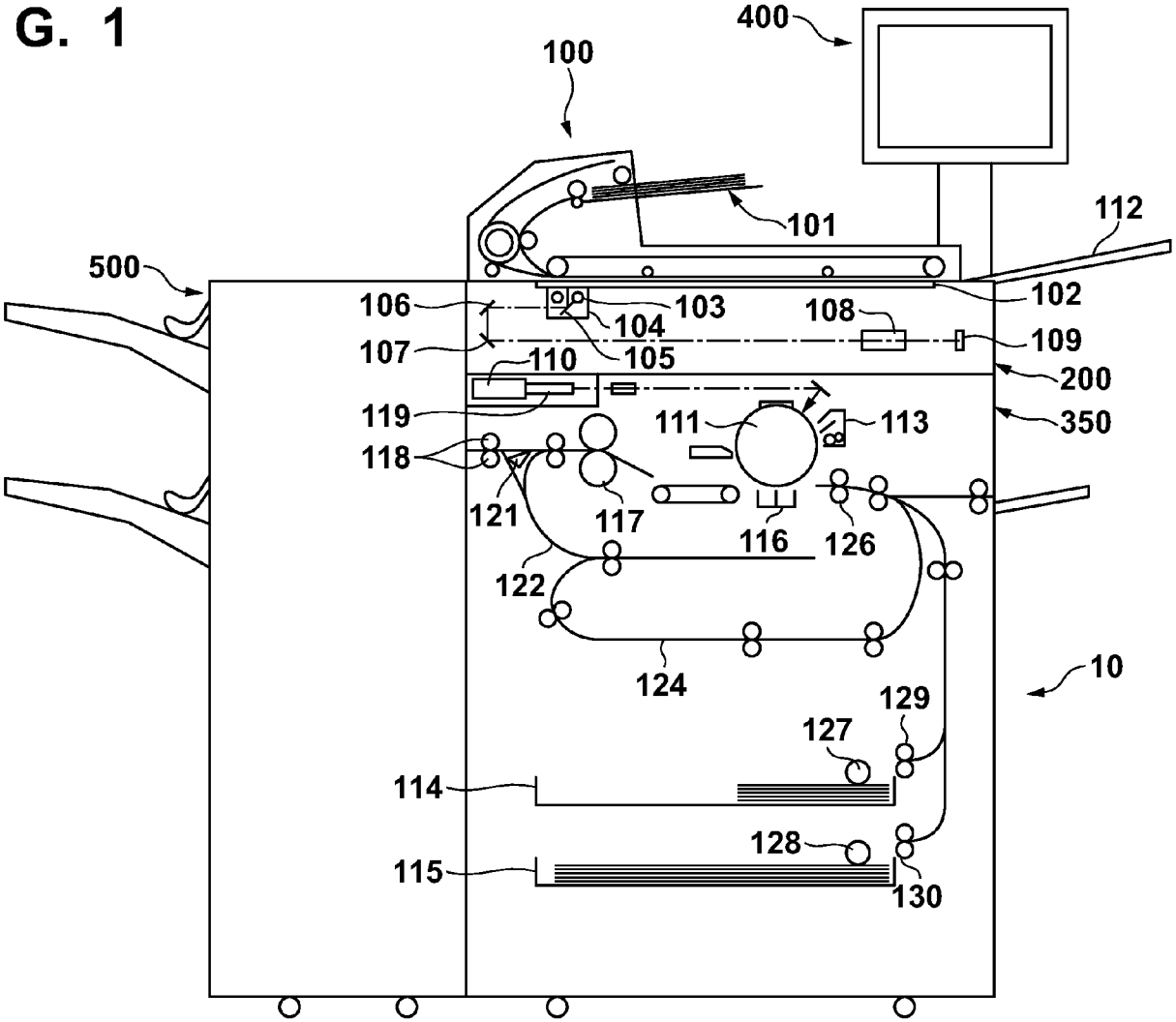
FIG. 1 is a configuration diagram showing cross-sectional configurations of main parts of an image forming system according to embodiments.

FIG. 1 is a configuration diagram showing cross-sectional configurations of main parts of an image forming system according to embodiments of the present invention.

This image forming system includes an image forming apparatus 10 and a finisher 500 that serves as a sheet stacker. The image forming apparatus 10 includes an image reader 200 that reads an image from an original, and a printer 350 that forms (prints) the read image on a sheet.

A document feeder 100 feeds originals set on an original tray 101 one by one in order starting from the top original, conveys the originals along a curved path and past a predetermined reading position on a glass platen 102, then discharges the originals onto a discharge tray 112. Note that the originals are set on the original tray 101 with their front sides up. At this time, a scanner unit 104 is fixed at the predetermined reading position. When an original passes the reading position, an image of the original is read by the scanner unit 104. When the original passes the reading position, the original is irradiated with light from a lamp 103 in the scanner unit 104, and reflected light from the original is directed to a lens 108 via mirrors 105, 106 and 107. Light that has passed through this lens 108 is focused on an imaging surface of an image sensor 109, converted into image data, and output. The image data output from the image sensor 109 is input as a video signal to an exposure unit 110 in the printer 350.

The exposure unit 110 in the printer 350 outputs laser light that has been modulated based on a video signal input from the image reader 200. A photosensitive drum 111 is irradiated with and scanned by this laser light using a polygonal mirror 119. An electrostatic latent image corresponding to the laser light that has scanned the photosensitive drum 111 is formed on the photosensitive drum 111. This electrostatic latent image on the photosensitive drum 111 turns into a visible image by being developed using a developing agent fed from a developer 113. In the following embodiments, a 1D-type image forming apparatus 10 including one developer 113 and one photosensitive drum 111 is described as an example. However, the present invention is not limited in this way, and the image forming apparatus 10 may alternatively include developers and photosensitive drums corresponding to C (cyan), M (magenta), Y (yellow) and K (black).

Sheets used in the printing are picked up one by one from a sheet feeding tray 114 or 115, which is provided in the printer 350, by rotation of a pickup roller 127 or 128. The sheet thus picked up is conveyed to the position of registration rollers 126 by rotation of sheet feeding rollers 129 or 130. Although FIG. 1 shows only two sheet feeding trays for the sake of explanation, the printer 350 may include other sheet feeding trays that are not shown in the figures. Furthermore, additional sheet feeding trays may be provided by connecting an optional sheet feeding apparatus not shown in the figures to the printer 350. When the leading edge of a sheet arrives at the position of the registration rollers 126, the registration rollers 126 are driven and rotated at a predetermined timing so as to convey the sheet between the photosensitive drum 111 and a transfer unit 116. Accordingly, an image of the developing agent formed on the photosensitive drum 111 is transferred to the fed sheet by the transfer unit 116. The sheet to which the image of the developing agent has been thus transferred is conveyed to a fixing unit 117. The fixing unit 117 fixes the image on the sheet by applying heat and pressure to the sheet. The sheet that has passed the fixing unit 117 is discharged to the outside of the printer 350 (to the finisher 500) via a flapper 121 and discharge rollers 118. In the case where images are formed on both sides of the sheet, the sheet is conveyed to a double-sided conveying path 124 via a reversing path 122, then conveyed to the position of the registration rollers 126 again.

Figure 2:
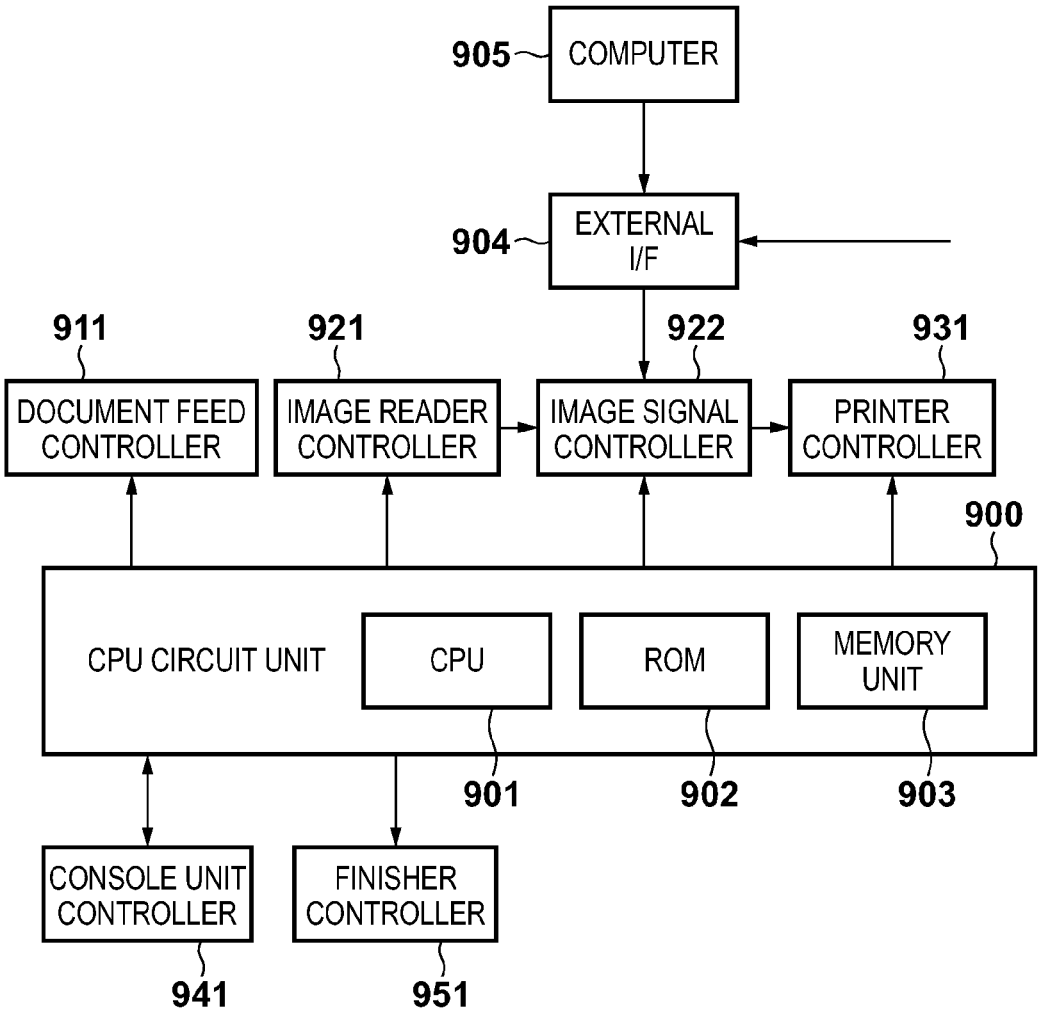
FIG. 2 is a block diagram showing a configuration of a controller that controls the entirety of the image forming system according to embodiments.

The following describes a configuration of a controller that controls the entirety of the image forming system and a block diagram of the entirety of the system according to some embodiments with reference to FIG. 2. FIG. 2 is a block diagram showing a configuration of a controller that controls the entirety of the image forming system according to embodiments.

The controller includes a CPU circuit unit 900, and the CPU circuit unit 900 includes a CPU 901, a ROM 902, and a memory unit 903. The memory unit 903 is constituted by a RAM or an HDD. The CPU 901 controls the entirety of the present image forming system, and is connected to the ROM 902 in which control programs are written and to the memory unit 903 for temporarily storing various types of data via an address bus and a data bus (not shown in the figures). The CPU 901 also performs overall control of controllers 911, 921, 922, 931, 941 and 951, as well as an external interface 904, in accordance with the control programs stored in the ROM 902. The memory unit 903 temporarily holds control data and is used as a working area for calculation processing associated with control.

A document feed controller 911 controls driving of the document feeder 100 based on instructions from the CPU circuit unit 900. An image reader controller 921 controls driving of the above-described scanner unit 104, image sensor 109, and the like, and transfers an image signal output from the image sensor 109 to an image signal controller 922. The image signal controller 922 converts an analog image signal from the image sensor 109 into a digital signal, applies various types of processing to the digital signal, converts the digital signal into a video signal, and outputs the video signal to a printer controller 931. The image signal controller 922 also converts a digital image signal input from a computer 905 via the external I/F 904 into a video signal by applying various types of processing to the digital image signal, and outputs the video signal to the printer controller 931. The operations of processing executed by this image signal controller 922 are controlled by the CPU circuit unit 900. The printer controller 931 controls the exposure unit 110 and the printer 350 based on the input video signal so as to form images, convey sheets, and the like. A finisher controller 951 is mounted on the finisher 500, and controls driving of the finisher 500 by exchanging information with the CPU circuit unit 900. The details of this control will be described later. A console unit controller 941 exchanges information with a console unit 400 shown in FIG. 1 and the CPU circuit unit 900. The console unit 400 includes, for example, a plurality of keys for setting various types of functions related to image formation, and a display unit for displaying information showing the states of settings. The console unit 400 outputs key signals corresponding to operations applied to the keys to the CPU circuit unit 900. Based on signals from the CPU circuit unit 900, the console unit 400 displays corresponding information.

Figure 3:
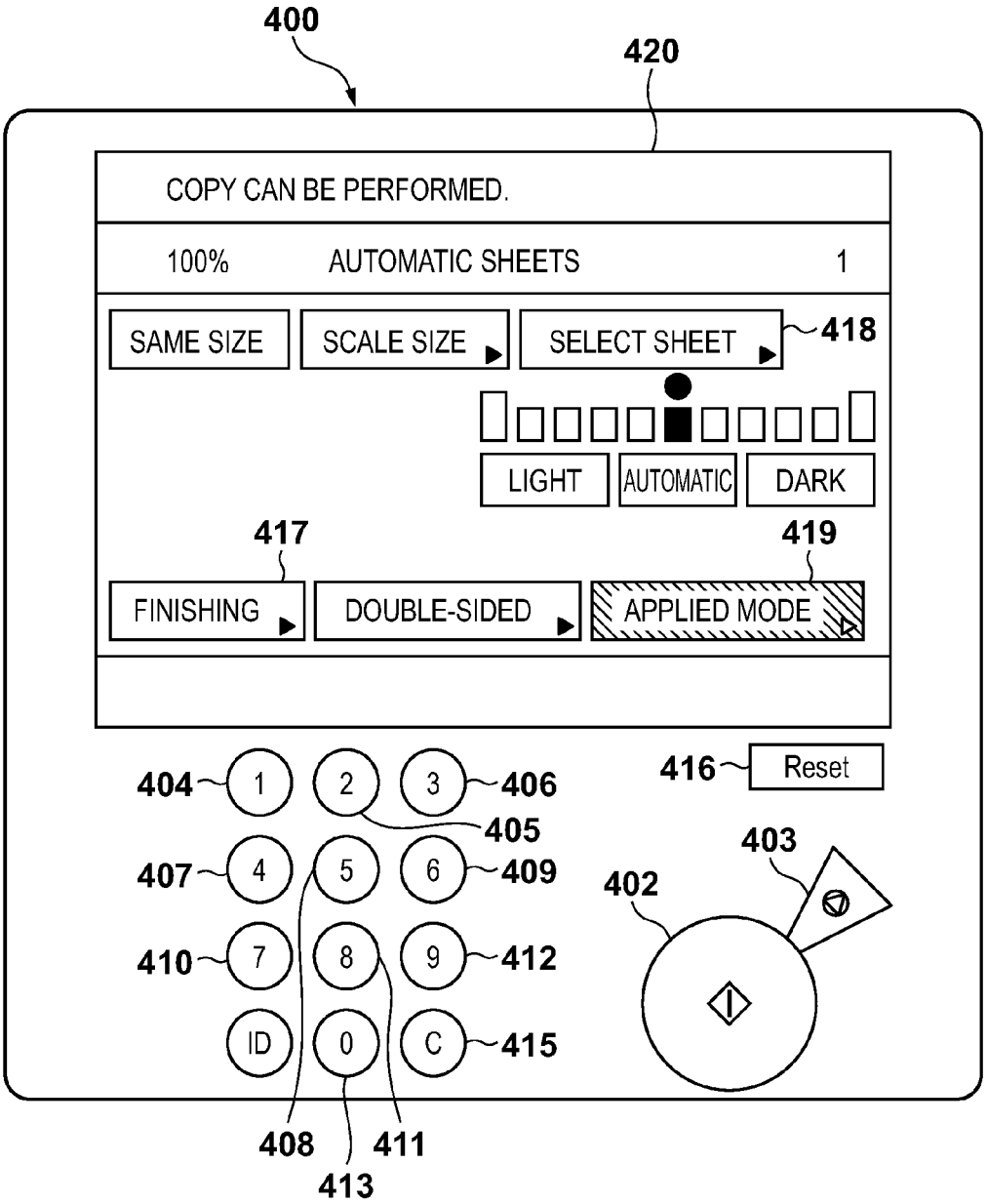
FIG. 3 is a diagram for describing a console unit in an image forming apparatus according to embodiments.

FIG. 3 is a diagram for describing the console unit 400 in the image forming apparatus 10 according to embodiments.

For example, a start key 402, a stop key 403, numeric keys 404 to 413, a clear key 415, and a reset key 416 are arranged on the console unit 400. The start key 402 is used to start the image forming operations. The stop key 403 is used to interrupt the image forming operations. The numeric keys 404 to 413 are used to, for example, enter numbers. A display unit 420 is also arranged on the console unit 400. A touchscreen is formed on the upper part of the display unit 420. Software keys can be displayed on a screen of the display unit 420.

This image forming apparatus 10 has various process modes as post-process modes, including no sort, sort, shift-sort, staple-sort, and the like. The settings and the like for these process modes are input from the console unit 400. For example, a post-process mode is set as follows. If a "Finishing" software key 417 is selected on a default screen shown in FIG. 3, a menu selection screen is displayed on the display unit 420. On this menu selection screen, a process mode is set.

Figure 4B:
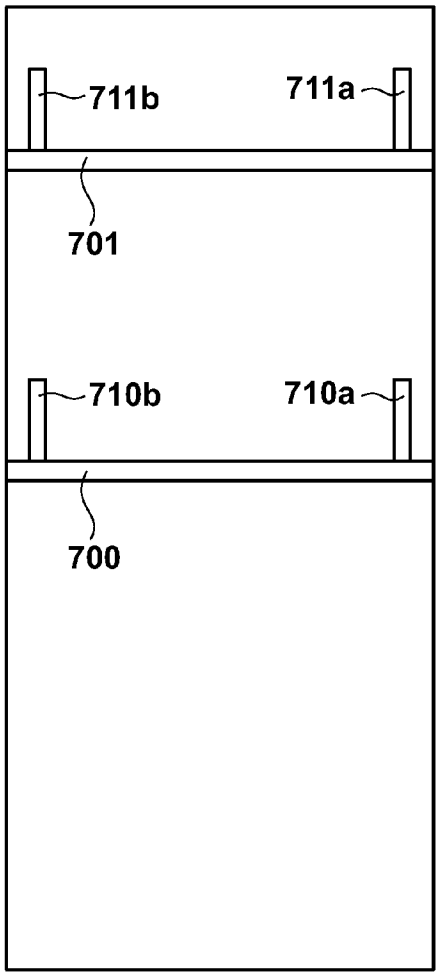
FIG. 4B shows the finisher according to embodiments as viewed in a direction opposing a sheet discharge direction.
Figure 4A:
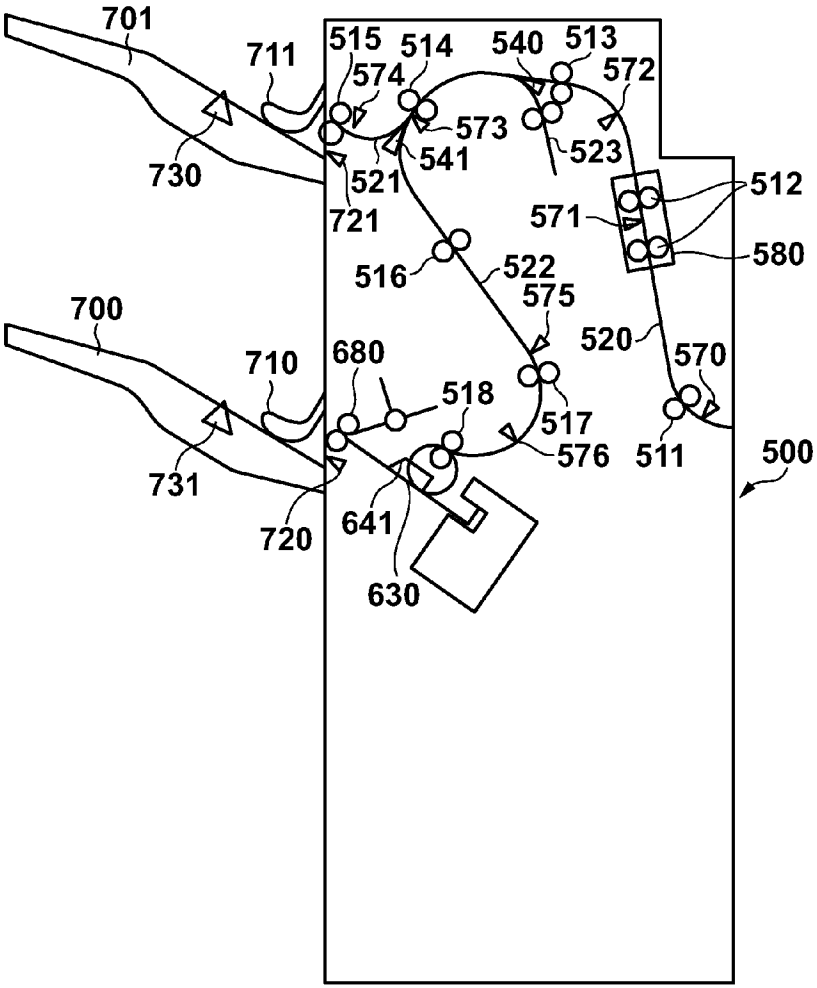
FIG. 4A shows a finisher according to embodiments as viewed from the front.

The following describes a configuration of the finisher 500 with reference to FIGS. 4A and 4B. FIGS. 4A and 4B are diagrams for describing a configuration of the finisher 500 according to embodiments. FIG. 4A shows the finisher 500 as viewed from the front, and FIG. 4B shows a receiving tray 700 (lower tray) and a receiving tray 701 (upper tray) in the finisher 500 as viewed in a direction opposing a sheet discharge direction.

First, a description is provided with reference to FIG. 4A.

The finisher 500 receives sheets discharged from the image forming apparatus 10 in order, and executes post-processes such as a process for aligning the plurality of received sheets in a bundle, and a staple process for binding the trailing edges of the bundle of sheets using a stapler. The finisher 500 receives a sheet discharged from the image forming apparatus 10 along a conveyance path 520 using a pair of conveyance rollers 511. The sheet that has been received using the pair of conveyance rollers 511 is conveyed via pairs of conveyance rollers 512, 513 and 514. Sheet sensors 570, 571, 572 and 573 are provided on the conveyance path 520 to detect passing of the sheet. The pair of conveyance rollers 512 is provided in a shift unit 580 together with the conveyance sensor 571.

Figure 5:
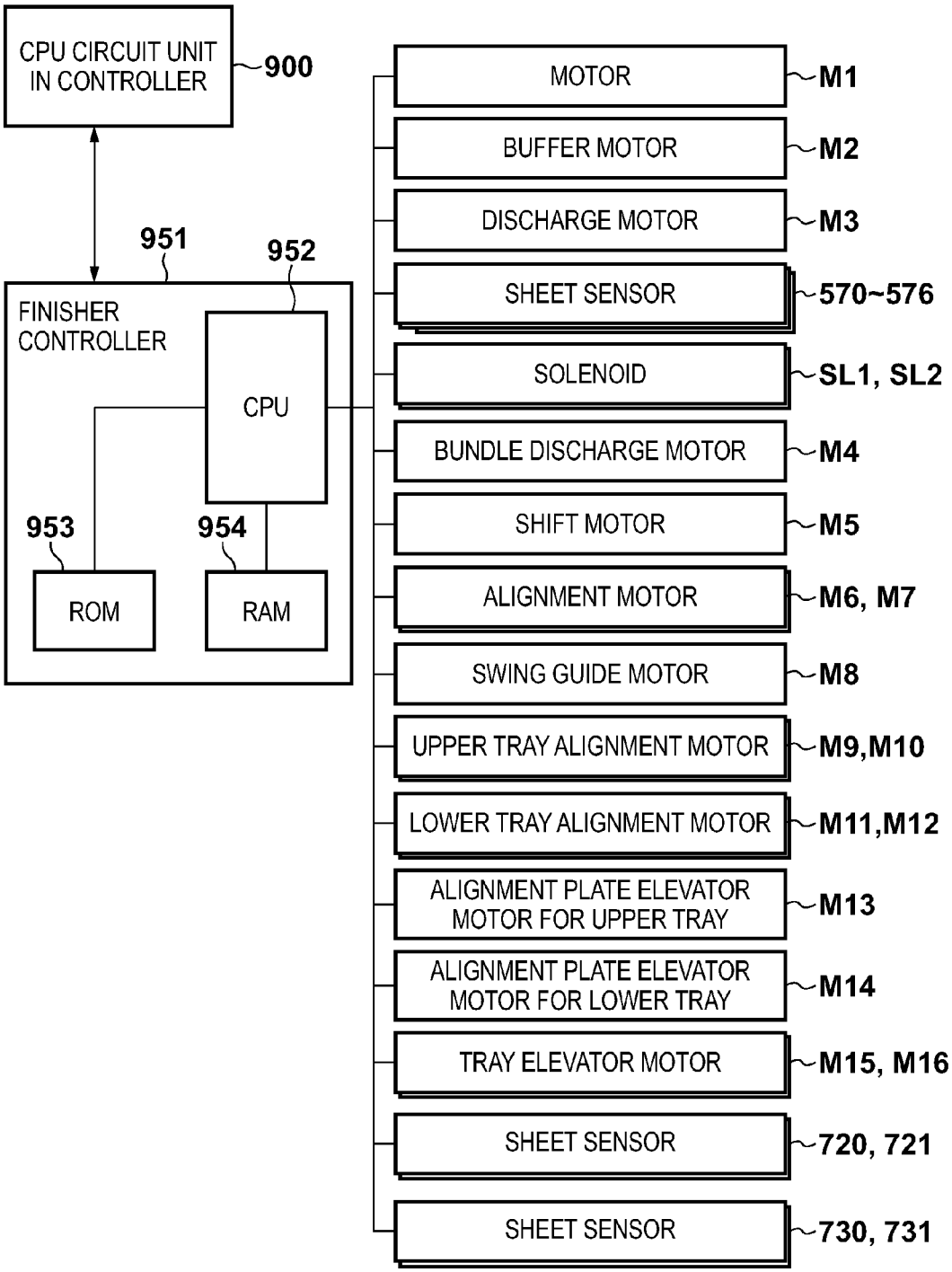
FIG. 5 is a block diagram showing a configuration of a finisher controller according to embodiments.

The shift unit 580 can move the sheet in a sheet width direction orthogonal to a sheet conveyance direction using a later-described shift motor M5 (FIG. 5). By driving the shift motor M5 while the pair of conveyance rollers 512 is holding the sheet therebetween, the sheet can be offset in the width direction while being conveyed. In a shift-sort mode, the position of a bundle of sheets is moved in the width direction on a per-copy basis. For example, an offset amount of 15 mm toward the front (front shift), or an offset amount of 15 mm toward the back (back shift), is set with respect to the center position in the width direction. When no designation is made regarding the shift, sheets are discharged at the same position as in the front shift.

When the finisher 500 detects that a sheet has passed the shift unit 580 based on the input from the sheet sensor 571, the finisher 500 drives the shift motor M5 (FIG. 5) to place the shift unit 580 back to the center position. A flapper 540, which directs a sheet conveyed in a reverse fashion by the pair of conveyance rollers 514 to a buffer path 523, is arranged between the pair of conveyance rollers 513 and the pair of conveyance rollers 514. The flapper 540 is driven by a later-described solenoid SL1 (FIG. 5).

A flapper 541, which switches between an upper discharge path 521 and a lower discharge path 522, is arranged between the pair of conveyance rollers 514 and the pair of conveyance rollers 515. The flapper 541 is driven by the later-described solenoid SL1. When the flapper 541 switches to the upper discharge path 521, a sheet is directed to the upper discharge path 521 by the pair of conveyance rollers 514 that is driven and rotated by a buffer motor M2 (FIG. 5). Then, the sheet is discharged onto the receiving tray 701 by the pair of conveyance rollers 515 that is driven and rotated by a discharge motor M3 (FIG. 5). A sheet sensor 574 is provided on the upper discharge path 521 to detect passing of the sheet. When the flapper 541 switches to the lower discharge path 522, the sheet is directed to the lower discharge path 522 by the pair of conveyance rollers 514 that is driven and rotated by the buffer motor M2. This sheet is further directed to a process tray 630 by pairs of conveyance rollers 516 to 518 that are driven and rotated by the discharge motor M3. Sheet sensors 575 and 576 are provided on the lower discharge path 522 to detect passing of the sheet. The sheet that has been directed to the process tray 630 is discharged onto the process tray 630 or the receiving tray 700, in accordance with a post-process mode, by a pair of bundle discharge rollers 680 driven and rotated by a bundle discharge motor M4 (FIG. 5).

Figure 6A:
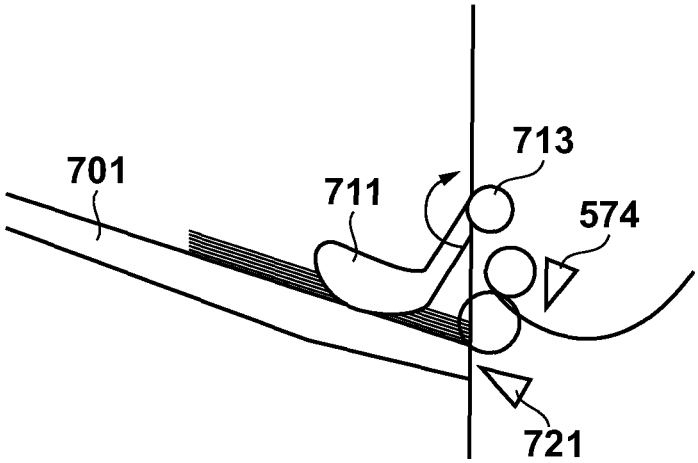
FIG. 6A depicts a view illustrating the state of alignment plates when aligning sheets on a receiving tray.
Figure 6B:
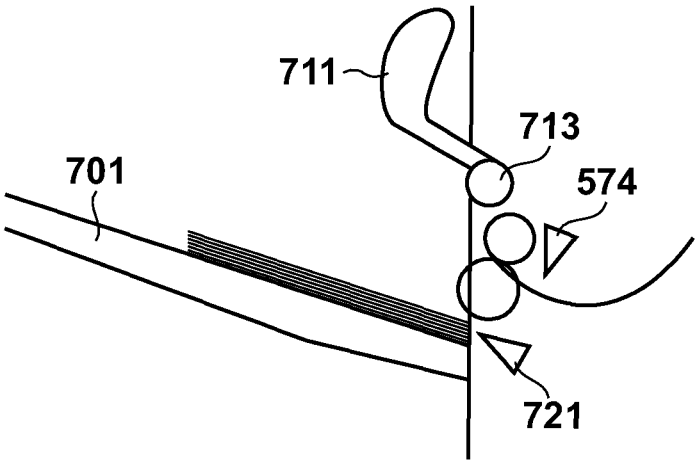
FIG. 6B depicts a view illustrating the state where alignment plates have been retracted from a receiving tray.

Furthermore, an alignment plate 711*a* (first alignment member) and an alignment plate 711*b* (second alignment member) are arranged on the receiving tray 701 as shown in FIG. 4B. The alignment plates 711*a* and 711*b* are alignment members for aligning sheets discharged onto the receiving tray 701 in the sheet width direction by coming into contact with both side edges (side ends) of the sheets. These alignment plates 711*a* and 711*b* are represented by a reference number 711 in FIG. 4A. Similarly, alignment plates 710*a* and 710*b* are arranged on the receiving tray 700. The alignment plates 710*a* and 710*b* are used to align sheets discharged onto the receiving tray 700 in the sheet width direction. The alignment plates 710*a* and 710*b*, which are represented by a reference number 710 in FIG. 4A, can be moved in the sheet width direction respectively by later-described lower tray alignment motors M11 and M12 (FIG. 5). In FIG. 4A, the alignment plates 710*a* and 710*b* are arranged respectively in the front and the back. On the other hand, the alignment plates 711*a* and 711*b* are similarly driven respectively by later-described upper tray alignment motors M9 and M10 (FIG. 5). In FIG. 4A, the alignment plates 711*a* and 711*b* are arranged respectively in the front and the back. Furthermore, the alignment plates 710 and 711 are moved up and down respectively by an alignment plate elevator motor M13 for an upper tray (FIG. 5) and an alignment plate elevator motor M14 for a lower tray (FIG. 5), which will be described later. More specifically, the alignment plates 710 and 711 are moved up and down about an alignment plate axis 713 between aligning positions where they actually execute an alignment process (FIG. 6A) and waiting positions where they wait (FIG. 6B).

The receiving trays 700 and 701 can be raised and lowered by later-described tray elevator motors M15 and M16 (FIG. 5). The topmost surface of a tray or sheets on a tray is detected by later-described sheet sensors 720 and 721 (FIG. 4A). The finisher 500 performs control so that this topmost surface of a tray or sheets on a tray is always located at a certain position by driving and rotating the tray elevator motors M15 and M16 in accordance with the input from the sheet sensors 720 and 721. Furthermore, sheet sensors 730 and 731 (FIG. 4A) detect whether or not there is any sheet on the receiving trays 701 and 700.

A description is now given of a configuration of the finisher controller 951 that controls driving of the finisher 500 with reference to FIG. 5. FIG. 5 is a block diagram showing a configuration of the finisher controller 951 according to embodiments.

The finisher controller 951 includes a CPU 952, a ROM 953, a RAM 954, and the like. The finisher controller 951 controls driving of the finisher 500 by communicating with the CPU circuit unit 900, exchanging data with the CPU circuit unit 900, and executing various types of programs stored in the ROM 953. The data exchange denotes, for example, transmission/reception of commands, exchange of job information, and notification of sheet transfer. The following describes various types of inputs and outputs of the finisher 500.

In order to convey sheets, the finisher 500 includes a motor M1 that drives and rotates the pairs of conveyance rollers 511 to 513, a buffer motor M2, a discharge motor M3, a shift motor M5, solenoids SL1 and SL2, and sheet sensors 570 to 576. The finisher 500 also includes, as means to drive various types of members in the process tray 630 (FIG. 4A), a bundle discharge motor M4 that drives the pair of bundle discharge rollers 680, and alignment motors M6 and M7 that drive alignment members 641 (FIG. 4A). The finisher 500 further includes a swing guide motor M8 that drives a swing guide to be raised and lowered. The finisher 500 further includes tray elevator motors M15 and M16 for raising and lowering the receiving trays 700 and 701, sheet sensors 720 and 721 (FIG. 4A), and sheet sensors 730 and 731. In relation to alignment operations for sheets on the receiving trays, the finisher 500 further includes upper tray alignment motors M9 and M10, lower tray alignment motors M11 and M12, an alignment plate elevator motor M13 for the upper tray, and an alignment plate elevator motor M14 for the lower tray.

Figure 10A:
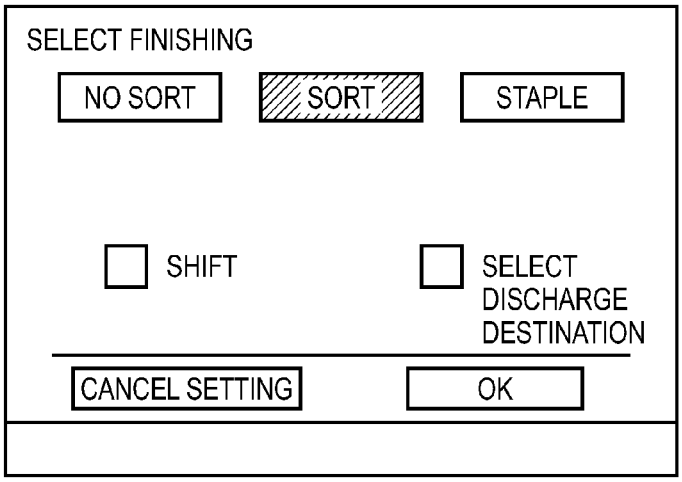
FIGS. 10A and 10B depict views illustrating examples of a finishing mode selection screen that is displayed on a console unit in the image forming apparatus according to embodiments.
Figure 10B:
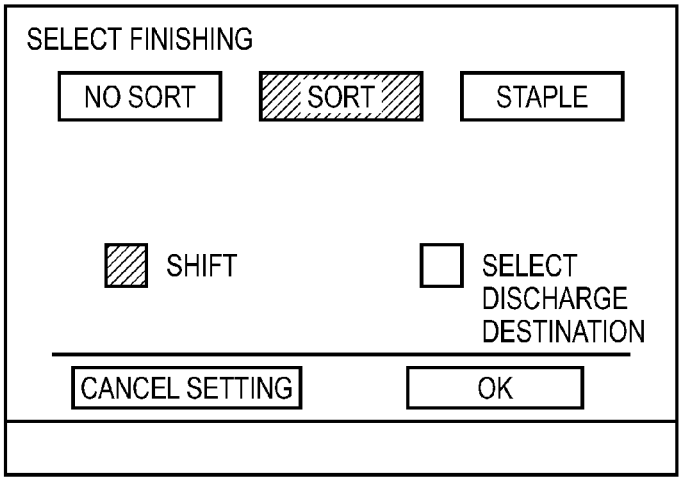
Figure 10C:
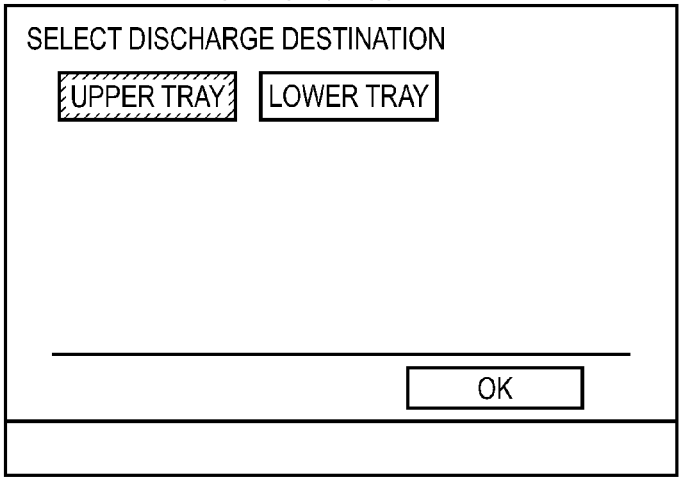
FIG. 10C depicts a view illustrating an example of a discharge destination selection screen that is displayed on the console unit in the image forming apparatus according to embodiments.
Figure 11:
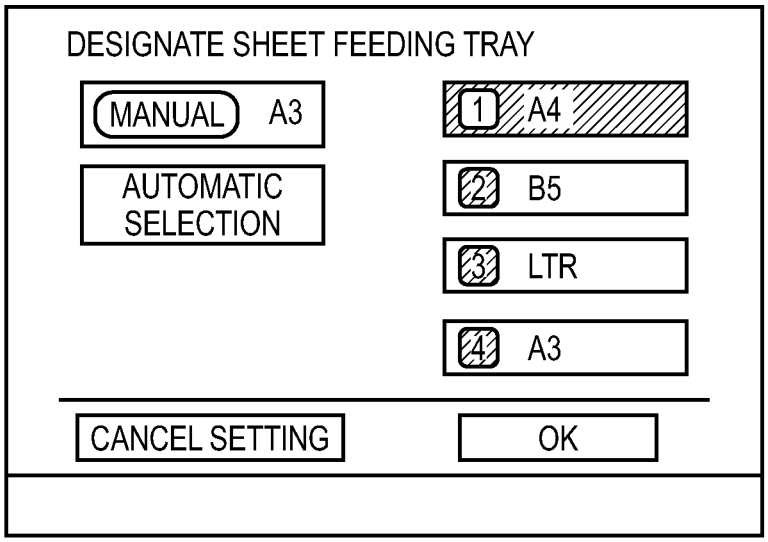
FIG. 11 depicts a view illustrating an example of a sheet feeding tray selection screen.

The following describes a flow of sheets during a sort mode with reference to FIGS. 3, 7, 8A to 8D, 10A to 10C, and 11. If the user presses a "Select Sheet" key 418 on the default screen shown in FIG. 3 on the console unit 400 of the image forming apparatus 10, a sheet feeding tray selection screen shown in FIG. 11 is displayed on the display unit 420. On this sheet feeding tray selection screen, the user selects sheets that are to be used for a job. It is assumed here that the user selects the size "A4" corresponding to a sheet feeding tray 1. FIG. 11 shows one example of the sheet feeding tray selection screen on which the size "A4" is selected.

If the user selects the "Finishing" software key 417 on the default screen shown in FIG. 3 on the console unit 400 of the image forming apparatus 10, a finishing menu selection screen shown in FIG. 10A is displayed on the display unit 420. If the user presses an OK button while a "Sort" key is selected on the finishing menu selection screen shown in FIG. 10A, the sort mode is set.

In order to offset a bundle of sheets on a per-copy basis, the user presses the OK button while a "Shift" key is selected on the finishing menu selection screen as shown in FIG. 10B; as a result, a shift mode is set.

Once the user has designated the sort mode and entered a job, the CPU 901 in the CPU circuit unit 900 notifies the CPU 952 in the finisher controller 951 of information related to that job, such as the sheet size and the selection of the sort mode. According to some embodiments, after sheets have been discharged in one print job, shift/discharge operations are applied to sheets printed in the next print job so that the sheets printed in the next print job are discharged at a different position from the sheets discharged in the preceding job. Such shift/discharge operations applied for each print job are referred to as an inter-job shift.

Figure 7:
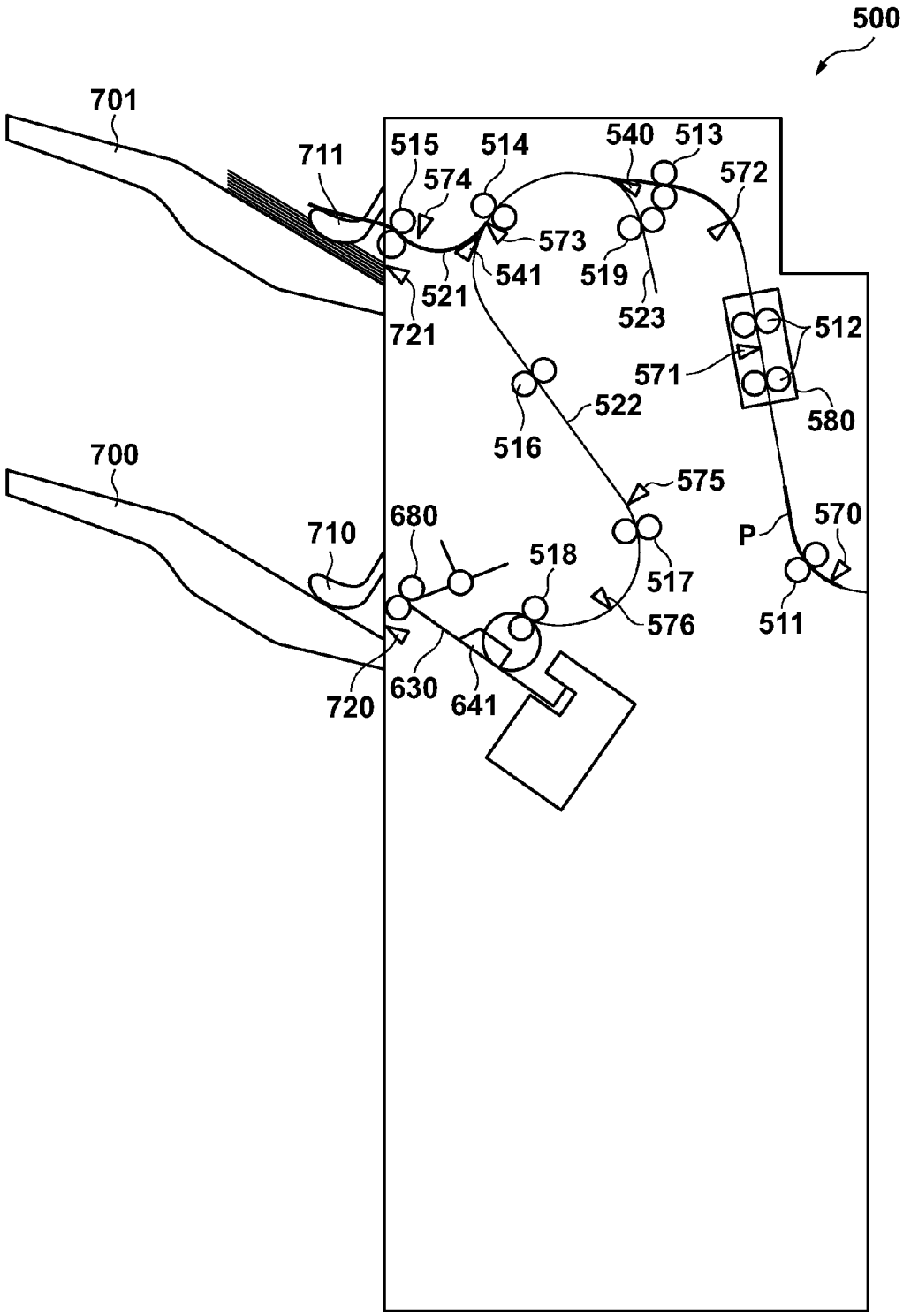
FIG. 7 is a diagram for describing the conveyance of sheets in the finisher according to embodiments.

FIG. 7 is a diagram for describing the conveyance of sheets in the finisher 500 according to embodiments. In FIG. 7, the parts that are shown in the above-described FIG. 4A are given the same reference signs thereas.

When the image forming apparatus 10 discharges a sheet P to the finisher 500, the CPU 901 in the CPU circuit unit 900 notifies the CPU 952 in the finisher controller 951 of the start of sheet transfer. The CPU 901 also notifies the CPU 952 in the finisher controller 951 of sheet information, such as shift information and sheet width information of the sheet P. It is assumed here that the sheet width information is stored in the ROM 902 or the memory unit 903 in advance for each sheet size. For example, an A4-sized sheet has a width of 297 mm, an A4R-sized sheet has a width of 210 mm, and a B5-sized sheet has a width of 257 mm. A letter-sized sheet has a width of 279.4 mm. An A3-sized sheet can only be conveyed with the short edge thereof serving as the leading edge, and therefore has a width of 297 mm. Upon receiving the notification of the start of sheet transfer, the CPU 952 drives and rotates the motor M1, the buffer motor M2 and the discharge motor M3. As a result, the pairs of conveyance rollers 511, 512, 513, 514 and 515 shown in FIG. 7 are driven and rotated, thus making the finisher 500 receive and transfer the sheet P discharged from the image forming apparatus 10. The sheet sensor 571 detects the sheet P when the pair of conveyance rollers 512 holds the sheet P therebetween. Accordingly, the CPU 952 offsets the sheet P in the width direction by moving the shift unit 580 through driving of the shift motor M5. When the shift information included in the sheet information notified from the CPU 901 shows "no shift designation", sheets are equally offset by 15 mm toward the front.

When the flapper 541 is driven and rotated by the solenoid S1 to be situated in the position shown in FIG. 7, the sheet P is directed to the upper discharge path 521. Then, when the sheet sensor 574 detects passing of the trailing edge of the sheet P, the CPU 952 discharges the sheet P onto the receiving tray 701 by driving and rotating the discharge motor M3 so that the sheet P is conveyed by the pair of conveyance rollers 515 at a speed suited for stacking.

Next, a description is given of the alignment operations during a sort mode, using an example of the front shift operations, with reference to FIGS. 8A to 8D. FIGS. 8A to 8D are diagrams for describing the positions of the alignment plates 711*a* and 711*b* on the receiving tray 701 as viewed in a direction opposing the sheet discharge direction.

Figure 8A:
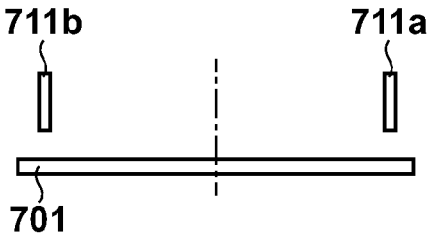
FIGS. 8A to 8D are diagrams for describing the positions of alignment plates on a receiving tray as viewed in a direction opposing the sheet discharge direction.
Figure 8B:
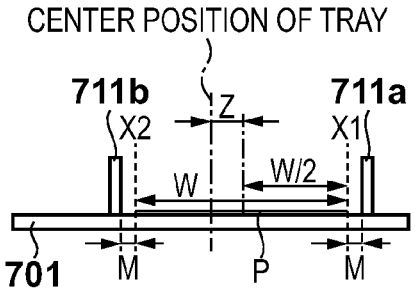
Figure 8C:
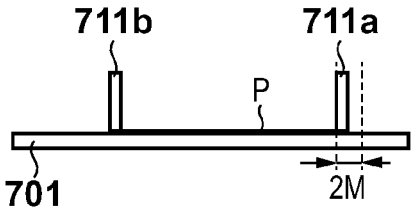
Figure 8D:
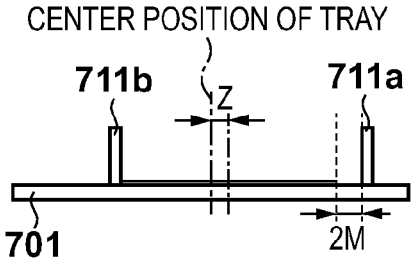

As shown in FIG. 8A, before a job is started, the pair of alignment plates 711*a* and 711*b* waits at default positions. As shown in FIG. 8B, once the job has been started, the front alignment plate 711*a* moves to an alignment waiting position that is distant from a front sheet edge position X1 by a predetermined retraction amount M. Note, the front sheet edge position X1 is distant from the center position of the receiving tray 701 by a distance obtained by adding a shift amount Z to W/2 which is half of the sheet width. The alignment plate 711*a* waits at this alignment waiting position until a sheet is discharged. On the other hand, the back alignment plate 711*b* waits at an alignment waiting position that is distant from a back sheet edge position X2 by the predetermined retraction amount M. Note, the back sheet edge position X2 is distant from the center position of the receiving tray 701 by a distance obtained by subtracting the shift amount Z from W/2 which is half of the sheet width. When a predetermined time period has elapsed since the sheet P was discharged onto the receiving tray 701, the front alignment plate 711*a* moves toward the center of the receiving tray 701 by a predetermined push amount 2M so as to press the sheet P against the stopped back alignment plate 711*b* as shown in FIG. 8C. As a result, the sheet P is moved toward the alignment plate 711*b* by the retraction amount M. When a predetermined period has elapsed since the sheet P was pressed against the alignment plate 711*b* in the above manner, the alignment plate 711*a* is retracted to the alignment waiting position as shown in FIG. 8D. More specifically, the alignment plate 711*a* is retracted away from the sheet P in the sheet width direction by 2M which is twice the retraction amount M, then waits until the next sheet is discharged onto the receiving tray 701. Provided that the offset amount Z is 15 mm and the retraction amount M is 5 mm, the front alignment plate 711*a* pushes the sheet P by 5 mm during the alignment operations, and therefore the offset amount of the sheet P after the alignment operations is 10 mm. By repeating the above operations, a sheet P is aligned each time it is discharged and stacked onto the receiving tray 701.

The following describes a flow of sheets during a shift-sort mode with reference to FIGS. 3, 7, 9A to 9G, and 10A to 10C. The shift-sort mode is set if the OK button is pressed while the "Sort" and "Shift" keys are selected on the finishing menu selection screen shown in FIG. 10B. Once the user has designated the shift-sort mode and entered a job, the CPU 901 in the CPU circuit unit 900 notifies the CPU 952 in the finisher controller 951 of the selection of the shift-sort mode, similarly to the case of a no sort mode. The following describes the operations for a shift-sort mode in the case where one "copy" is composed of three sheets.

When the image forming apparatus 10 discharges a sheet P to the finisher 500, the CPU 901 in the CPU circuit unit 900 notifies the CPU 952 in the finisher controller 951 of the start of sheet transfer. Upon receiving the notification of the start of sheet transfer, the CPU 952 drives and rotates the motor M1, the buffer motor M2 and the discharge motor M3. As a result, the pairs of conveyance rollers 511, 512, 513, 514 and 515 shown in FIG. 7 are driven and rotated, thus making the finisher 500 receive and transfer the sheet P discharged from the image forming apparatus 10. When the sheet sensor 571 detects that the sheet P is held between the pair of conveyance rollers 512, the CPU 952 offsets the sheet P by moving the shift unit 580 through driving of the shift motor M5. At this time, the sheet P is offset by 15 mm toward the front when the shift information of the sheet P notified from the CPU 901 shows "front", and toward the back when the shift information of the sheet P notified from the CPU 901 shows "back". The flapper 541 is driven and rotated by the solenoid S1 to be situated in the position shown in FIG. 7, and the sheet P is directed to the upper discharge path 521. When the sheet sensor 574 detects passing of the trailing edge of the sheet P, the CPU 952 discharges the sheet P onto the receiving tray 701 by driving and rotating the discharge motor M3 so that the pair of conveyance rollers 515 rotates at a speed suited for stacking the sheet P.

The following describes the operations of the alignment plates at the time of the shifting, using the exemplary case where the shift direction is changed from the front to the back, with reference to FIGS. 9A to 9G. FIGS. 9A to 9G are diagrams for describing the positions of alignment plates on the receiving tray 701 at the time of shift-sorting, as viewed in a direction opposing the sheet discharge direction.

Figure 9A:
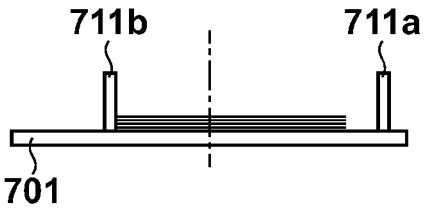
FIGS. 9A to 9G are diagrams for describing the positions of alignment plates on a receiving tray during a shift-sort mode, as viewed in a direction opposing the sheet discharge direction.
Figure 9B:
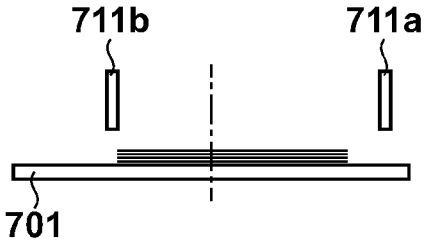

FIG. 9A shows the positions of alignment plates after sheets are aligned, that is to say, the state where the operation for retracting the front alignment plate 711*a* away from the sheets has finished (corresponding to FIG. 8D described above). Thereafter, as shown in FIG. 9B, the alignment plates 711*a* and 711*b* are raised upward away from the receiving tray 701 by a predetermined amount.

Figure 9C:
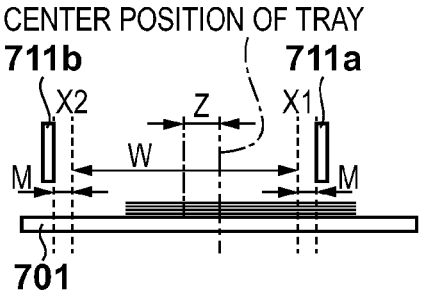

Next, the alignment plates 711*a* and 711*b* move in the sheet width direction to their respective alignment waiting positions for the next sheet. More specifically, on a bundle of sheets that are already stacked on the receiving tray 701, a next sheet is to be discharged while being shifted toward the back compared to the bundle of already-stacked sheets. As shown in FIG. 9C, the front alignment plate 711*a* moves to an alignment waiting position that is distant from the front sheet edge position X1 by the predetermined retraction amount M. Note, the front sheet edge position X1 is distant from the center position of the receiving tray 701 by a distance obtained by subtracting the shift amount Z from W/2 which is half of the sheet width. On the other hand, the back alignment plate 711*b* moves to an alignment waiting position that is distant from the back sheet edge position X2 by the predetermined retraction amount M. Note, the back sheet edge position X2 is distant from the center position of the receiving tray 701 by a distance obtained by adding the shift amount Z to W/2 which is half of the sheet width.

Figure 9D:
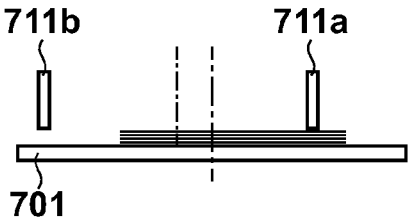

Once the alignment plates 711*a* and 711*b* have moved to their respective alignment waiting positions, the alignment plates 711*a* and 711*b* are lowered toward the receiving tray 701 by a predetermined amount and wait until the next sheet is discharged onto the receiving tray 701 as shown in FIG. 9D. At this time, the alignment plate 711*a* is in contact with (touches) the top surface of the topmost sheet of the already-stacked sheets.

Figure 9E:
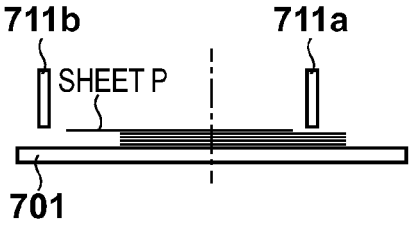
Figure 9F:
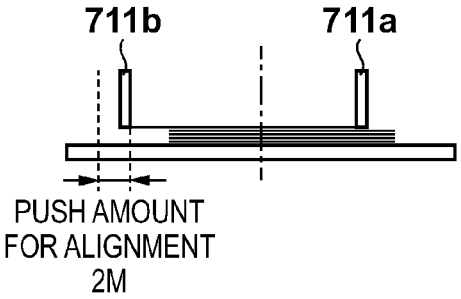
Figure 9G:
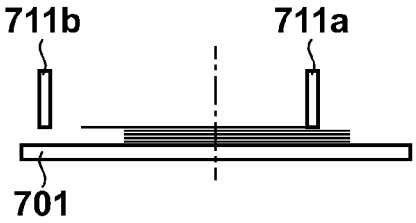

Thereafter, as shown in FIG. 9E, a sheet P is discharged onto the receiving tray 701. When a predetermined time period has elapsed since the discharge, the alignment plate 711*b* moves toward the center of the receiving tray 701 by the predetermined push amount 2M so as to press the sheet P against the alignment plate 711*a* as shown in FIG. 9F. When a predetermined time period has elapsed in the state of FIG. 9F, the alignment plate 711*b* is retracted away from the center of the receiving tray 701 by the predetermined push amount 2M and waits until the next sheet is discharged onto the receiving tray 701 as shown in FIG. 9G. It should be noted that the above operation for moving the alignment plate 711*b* toward the center of the receiving tray 701 by the predetermined push amount 2M and then retracting the alignment plate 711*b* away from the center of the receiving tray 701 by the predetermined push amount 2M (reciprocating operation) may be executed only once, or may be repeatedly executed for a predetermined number of times.

As described above, if the positions of sheets to be stacked are changed (shifted) in the width direction, the alignment plates are first raised upward away from the receiving tray, then lowered after changing the aligning positions of the alignment plates so as to prepare for alignment of the sheets to be discharged next. Each time a sheet is discharged onto already-stacked sheets, sheet alignment operations are executed at the shifted positions.

In this case, the alignment plate 711*a* that is in contact with (touches) the top surface of the topmost sheet of the stacked sheets does not move; instead, the alignment plate 711*b* that is not in contact with the stacked sheets moves in a direction orthogonal to the sheet conveyance direction and applies the alignment operations to the newly-discharged sheet. This can prevent the alignment plate 711*a* from sliding against and staining the top surface of the topmost sheet of the stacked sheets, or at least reduce the stain.

If a "Select Discharge Destination" key is selected on the finishing menu selection screen shown in FIG. 10A, a discharge destination selection screen shown in FIG. 10C is displayed on the display unit 420. If the user selects a discharge destination and presses the OK button on this discharge destination selection screen, the discharge destination is selected ("Upper Tray" (corresponding to the receiving tray 701 in FIG. 7) is selected in FIG. 10C). Thereafter, the finishing menu selection screen shown in FIG. 10A is displayed on the display unit 420 again.

Figure 12A:
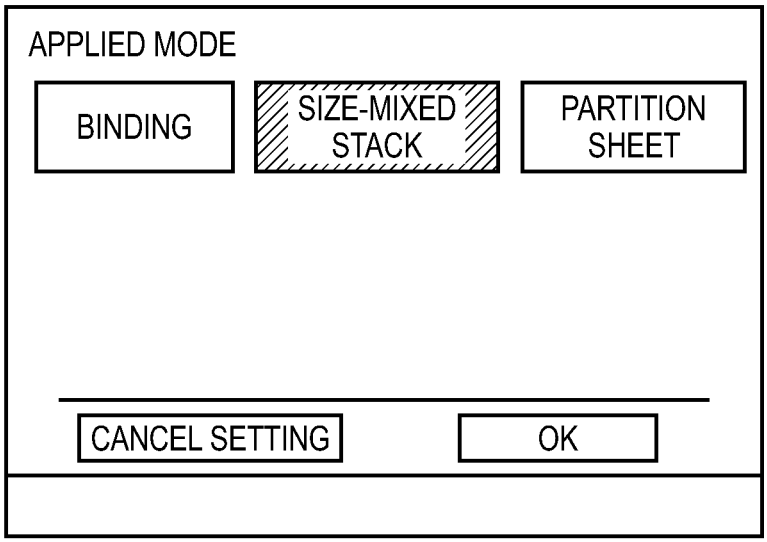
FIG. 12A depicts a view illustrating an example of an applied mode selection screen.
Figure 12B:
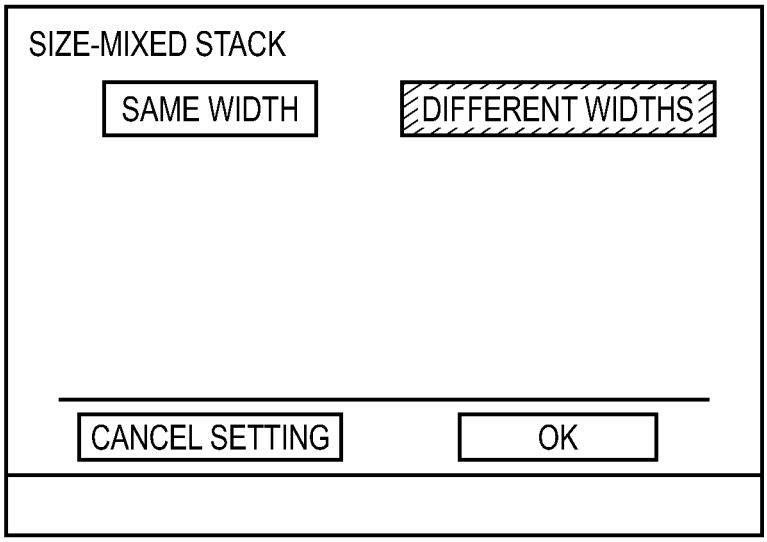
FIG. 12B depicts a view illustrating an example of a screen for designating whether size-mixed stack involves the same width or different widths.

The following describes different width-mixed stack, in which a plurality of types of sheets having different widths are stacked on a receiving tray. If the "Select Sheet" key 418 is pressed on the screen shown in FIG. 3, the screen is switched to the sheet feeding tray selection screen shown in FIG. 11. If the user selects an "Automatic Selection" key on this sheet feeding tray selection screen, an automatic sheet selection mode is set in which a sheet having a size corresponding to the size of an original is automatically selected. If the user presses an "Applied Mode" key 419 on the screen shown in FIG. 3, the screen is switched to an applied mode selection screen shown in FIG. 12A. If the user presses a "Size-Mixed Stack" key on the applied mode selection screen, the applied mode selection screen is switched to a size-mixed stack screen shown in FIG. 12B. If the user selects a "Different Widths" key and presses the OK button on this screen, a different width-mixed stack mode is set. If the user presses the start key 402 on the console unit 400 in this state, a plurality of originals stacked on the document feeder 100 are fed one by one, and a copy process is executed by automatically selecting a sheet feeding tray that stores sheets corresponding to each original size. In this way, sheets corresponding to different original sizes are fed and printed. As a result, a plurality of sheets having different widths are stacked on a receiving tray in a mixed manner.

Also, in the case where data generated by a computer is received and printed instead of copying images of originals, if the data includes a mixture of pages with different image sizes, a plurality of printed sheets having different widths will be stacked on a receiving tray in a mixed manner.

The above has described an example of different width-mixed stack that occurs in one print job. The following describes different width-mixed stack that occurs in two print jobs.

If the user selects the "Select Sheet" key 418 on the screen shown in FIG. 3, the screen is switched to the sheet feeding tray selection screen shown in FIG. 11. It is assumed here that the user selects a sheet feeding tray corresponding to "A4". When printing is performed in this state, A4-sized printed sheets are stacked on a receiving tray. Now, assume that the user subsequently selects the "Select Sheet" key 418 on the screen shown in FIG. 3 and selects a sheet feeding tray corresponding to "B5" on the screen shown in FIG. 11. In this case, if printing is performed without changing a discharge destination for sheets, the B5-sized sheets printed in the subsequent job are stacked on the A4-sized printed sheets that were stacked on the receiving tray in the immediately preceding print job.

Also, in the case where data generated by a computer is received and printed instead of copying images of originals, if sheets to be used in different print jobs have different sizes, a plurality of sheets having different widths will be stacked on a receiving tray in a mixed manner.

When sheets having a smaller width than printed sheets that are already stacked on a tray are to be stacked and aligned on the already-stacked sheets, it is necessary to prevent the alignment plates from sliding against the topmost sheet of the already-stacked sheets through the movement for the alignment (reciprocating operations). In view of this, the following describes a procedure for setting a partition sheet that is inserted onto the topmost sheet as necessary.

Figure 13A:
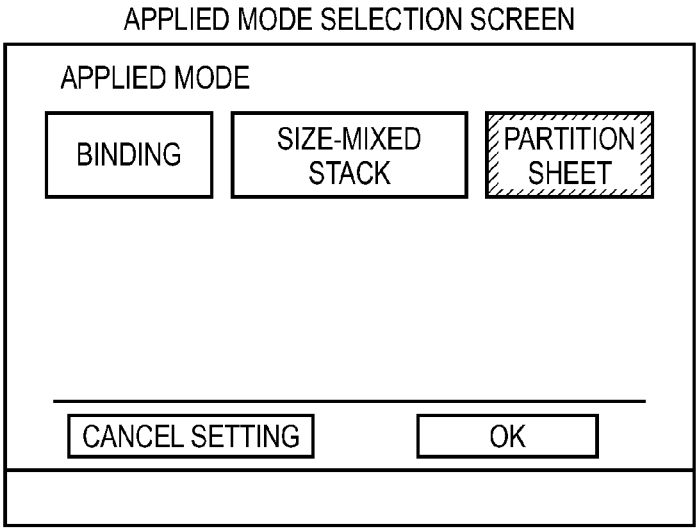
FIG. 13A depicts a view illustrating an example of an applied mode selection screen for selecting a partition sheet according to embodiments.
Figure 13B:
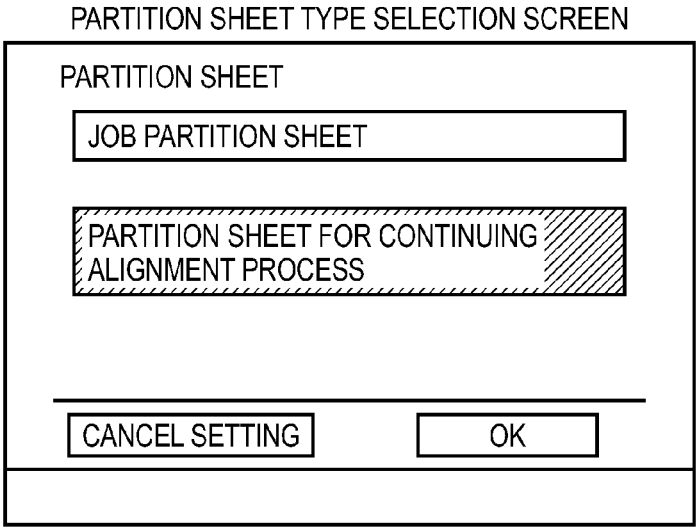
FIG. 13B depicts a view illustrating a partition sheet type selection screen.
Figure 13C:
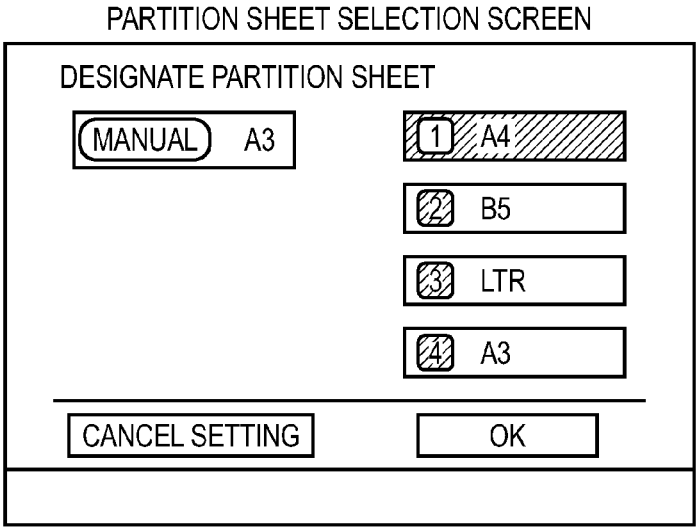
FIG. 13C depicts a view illustrating an example of a screen for selecting a sheet feeding tray of a partition sheet.

If the user presses the "Applied Mode" key 419 on the screen shown in FIG. 3, the screen is switched to an applied mode selection screen shown in FIG. 13A. If the user selects "Partition Sheet" and presses the OK button on the applied mode selection screen, the applied mode selection screen is switched to a partition sheet type selection screen shown in FIG. 13B. If the user selects "Partition Sheet for Continuing Alignment Process" and presses the OK button on the partition sheet type selection screen, the partition sheet type selection screen is switched to a partition sheet selection screen shown in FIG. 13C. On this partition sheet selection screen, the user selects a sheet feeding tray housing partition sheets. In FIG. 13C, a sheet feeding tray 1 in which A4-sized partition sheets are set is selected. If the user presses the OK button on this partition sheet selection screen, the A4-sized partition sheets set in the sheet feeding tray 1 are set as the partition sheets for continuing the alignment process. It should be noted that "Job Partition Sheet" shown in FIG. 13B represents a function of inserting a designated partition sheet between jobs. As opposed to this, a partition sheet described in the present embodiment is inserted to protect the already-stacked sheets when it is determined that the alignment plates will slide against the already-stacked sheets. That is to say, a partition sheet described in the present embodiment and a job partition sheet are used for different purposes.

Figure 14:
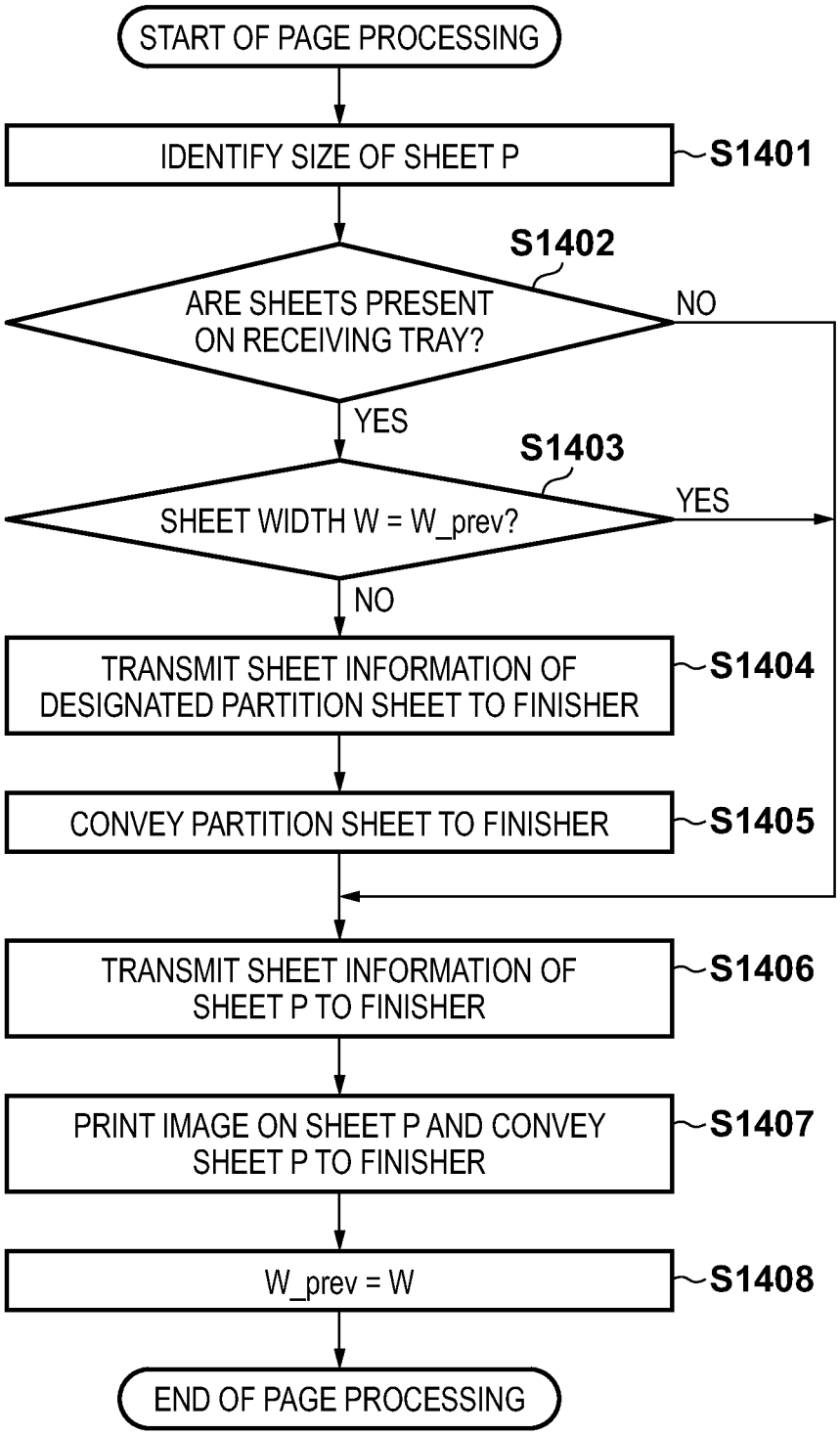
FIG. 14 shows a flowchart for describing processing in which an image forming apparatus according to the first embodiment prints a sheet and discharges the printed sheet to a finisher.

A description is now given of page printing operations executed by the CPU 901 in the CPU circuit unit 900 in the controller according to the present embodiment with reference to a flowchart of FIG. 14.

FIG. 14 shows a flowchart for describing processing in which the image forming apparatus 10 according to the first embodiment prints a sheet and discharges the printed sheet to the finisher 500. A program for executing this processing is stored in the ROM 902. This processing is realized by the CPU 901 executing the stored program.

First, in step S1401, the CPU 901 identifies the size of a sheet P to be used in printing based on the input print settings and image data. Then, the CPU 901 proceeds to step S1402 and determines, based on the input from the sheet sensor 730 or 731, whether or not sheets that have already been printed (first sheets) are placed on a receiving tray onto which the printed sheet P should be discharged. Note that the receiving tray onto which the printed sheet P should be discharged may be decided on in accordance with the input print settings, or may have been decided on as the setting for the image forming apparatus 10. The CPU 901 proceeds to step S1403 if it determines that sheets are placed on the receiving tray onto which the sheet P (second sheet) should be discharged, and to step S1406 if it determines that no sheet is placed on the receiving tray onto which the sheet P (second sheet) should be discharged. In step S1403, the CPU 901 determines whether or not the sheet width W of the sheet P that was identified in step S1401 is equal to a variable W_prev that is stored in the memory unit 903 and indicates the sheet width of a preceding sheet. The CPU 901 proceeds to step S1406 if it determines that the sheet width W of the sheet P is equal to the variable W_prev, and to step S1404 if it determines otherwise.

In step S1404, the CPU 901 notifies the CPU 952 in the finisher controller 951 in the finisher 500 of sheet information of a partition sheet that was designated using the screens shown in FIGS. 13A to 13C, and proceeds to step S1405. This notified sheet information includes information indicating that a sheet to be conveyed is a partition sheet. In step S1405, the CPU 901 controls the printer controller 931 to feed the partition sheet from the sheet feeding tray that was designated on the screen shown in FIG. 13C, and to convey the fed partition sheet to the finisher 500, and then proceeds to step S1406.

In step S1406, the CPU 901 notifies the CPU 952 in the finisher controller 951 in the finisher 500 of the information of the sheet P, and then proceeds to step S1407. In step S1407, the CPU 901 controls the printer controller 931 to print an image on the sheet P and to convey the printed sheet P to the finisher 500, and then proceeds to step S1408. In step S1408, the CPU 901 substitutes the width W of the sheet P that was printed in step S1401 into W_prev, and ends the page printing operations for the sheet P. Note that W_prev is stored in the memory unit 903.

Through the above processes, when sheets having a different size from sheets that were previously printed and are stacked on a tray are to be newly printed and discharged onto the same tray, the newly printed sheets can be discharged after discharging a partition sheet onto the already-stacked sheets. This makes it possible to prevent the already-stacked sheets from being stained or damaged by the alignment members coming into contact with the front surface of the already-stacked sheets through the alignment process applied to the newly printed sheets.

Figure 15A:
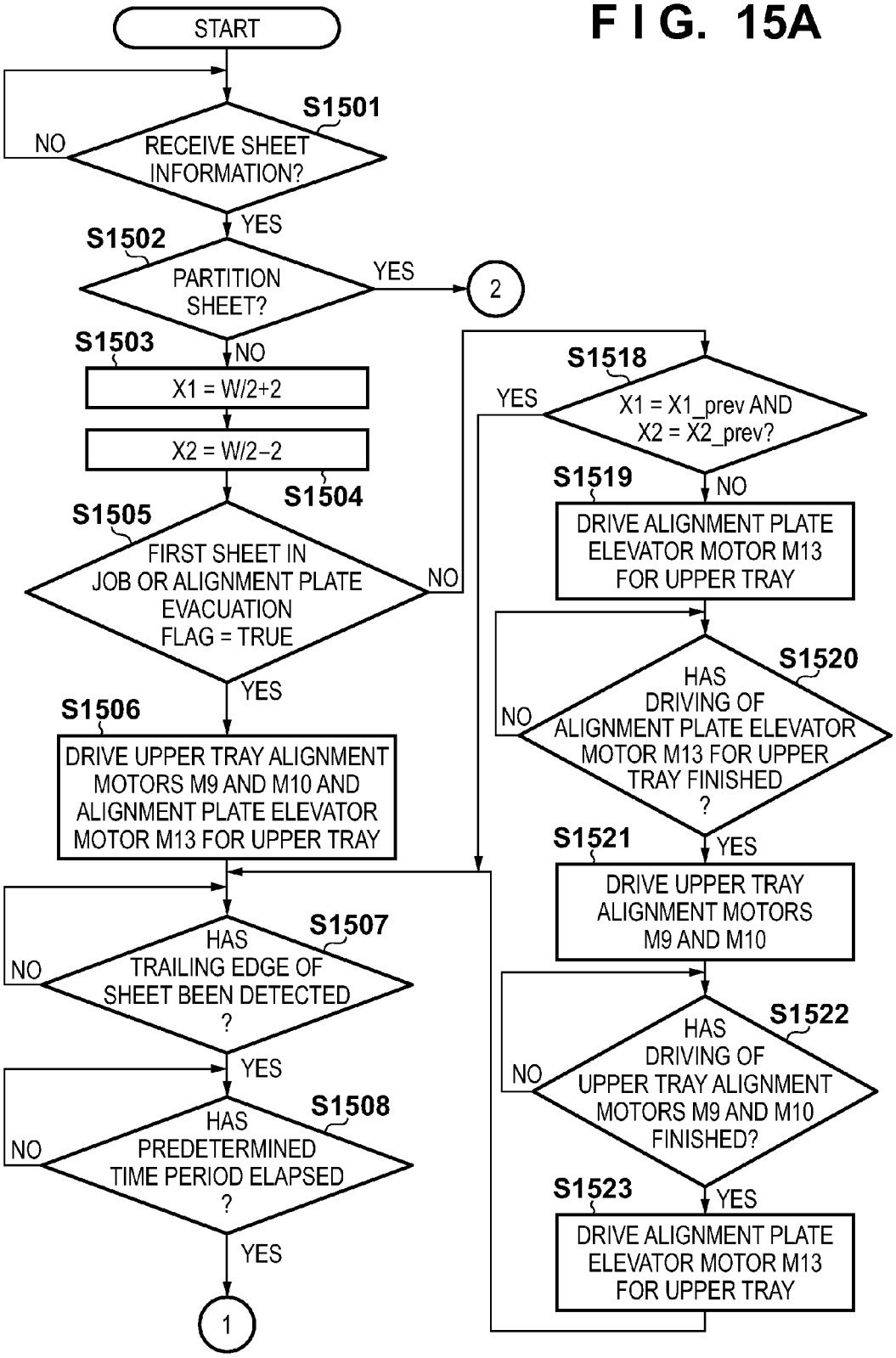
FIGS. 15A and 15B show flowcharts for describing discharge operations executed by the finisher according to the first embodiment.
Figure 15B:
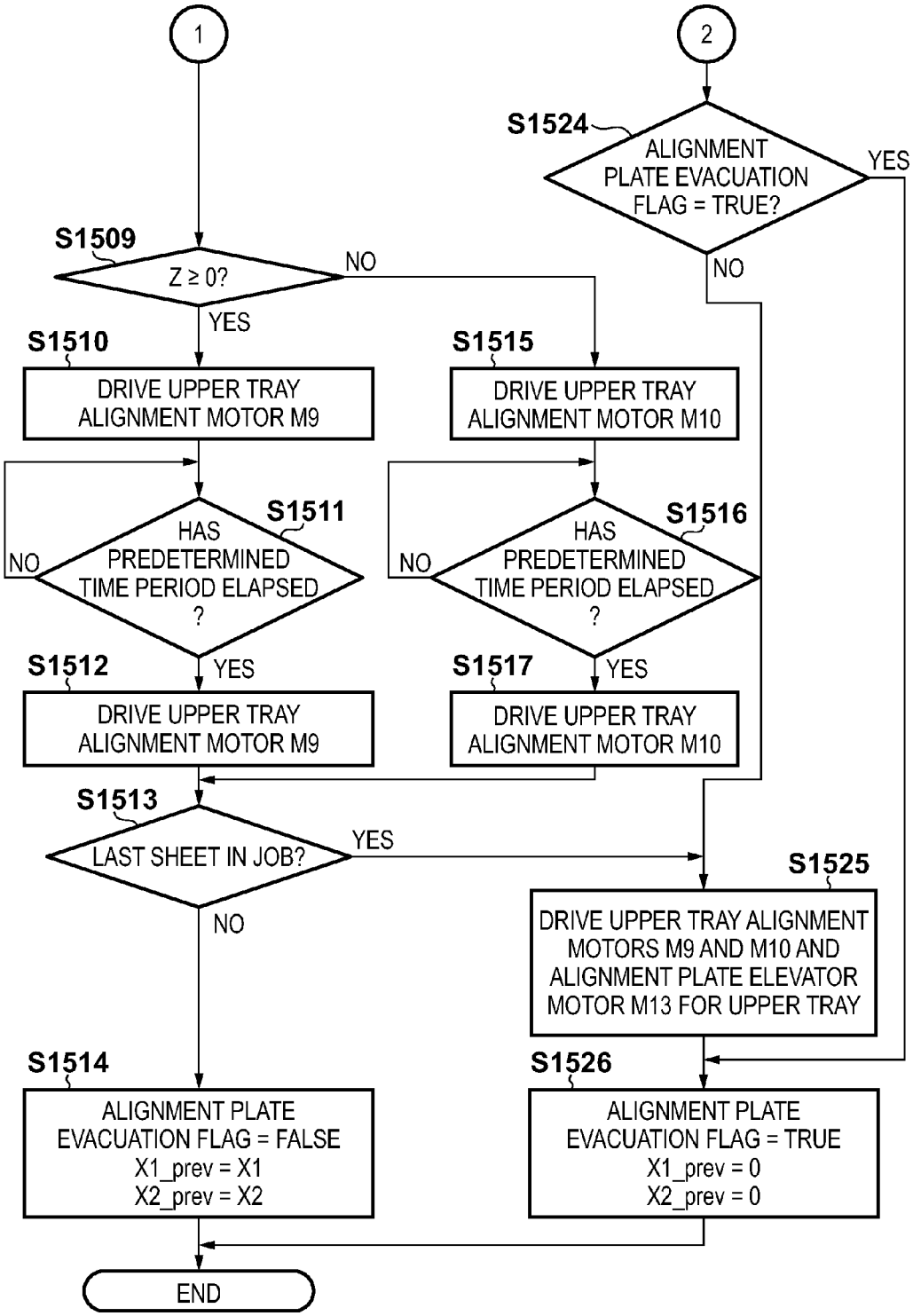

FIGS. 15A and 15B show flowcharts for describing the discharge operations executed by the finisher 500 according to the first embodiment. A program for executing processing of these flowcharts is stored in the ROM 953 in the finisher controller 951. This processing is realized by the CPU 952 executing the stored program. This processing is described below using the example in which sheets are discharged onto the receiving tray 701, namely the upper tray.

First, in step S1501, the CPU 952 determines whether or not it has been notified of sheet information by the CPU 901 in the image forming apparatus 10. This sheet information includes information indicating whether or not a sheet is a partition sheet, job information indicating whether the sheet is the first sheet or the last sheet in the job if the sheet is not a partition sheet, the sheet width W, and the offset amount Z. This sheet information may include information related to a single job, or information related to a plurality of jobs. The CPU 952 proceeds to step S1502 if it has been notified of the sheet information, and returns to step S1501 if it has not been notified of the sheet information. In step S1502, the CPU 952 determines whether or not a sheet to be conveyed is a partition sheet based on the sheet information received in step S1501. The CPU 952 proceeds to step S1524 (FIG. 15B) if the sheet is a partition sheet, and to step S1503 if the sheet is not a partition sheet. In step S1503, the CPU 952 calculates the front sheet edge position X1 shown in FIG. 8B based on the sheet width W and the offset amount Z using the following equation 1, stores the calculated front sheet edge position X1 in the RAM 954, and proceeds to step S1504.

$$X1 = W/2 + Z \quad \text{[Equation 1]}$$

In step S1504, the CPU 952 calculates the back sheet edge position X2 shown in FIG. 8B based on the sheet width W and the offset amount Z using the following equation 2, stores the calculated back sheet edge position X2 in the RAM 954, and proceeds to step S1505.

$$X2 = W/2 - Z \quad \text{[Equation 2]}$$

In step S1505, the CPU 952 determines whether or not the sheet to be conveyed is the first sheet in the print job based on the sheet information, or whether or not the alignment plates have been retracted with reference to an alignment plate retraction flag stored in the RAM 954. The CPU 952 proceeds to step S1506 if it determines that the sheet to be conveyed is the first sheet in the job or that the alignment plate retraction flag is set to TRUE, and proceeds to step S1518 if it determines otherwise. In step S1506, the CPU 952 drives and rotates the upper tray alignment motors M9 and M10 and the alignment plate elevator motor M13 for the upper tray 701 so as to move the alignment plates 711 from the default positions shown in FIG. 8A to the waiting positions shown in FIG. 8B, and then proceeds to step S1507.

In step S1507, the CPU 952 determines whether or not the trailing edge of the sheet to be discharged onto the upper tray 701 has been detected based on the output from the conveyance sensor 574. The CPU 952 proceeds to step S1508 if the trailing edge of the sheet has been detected, and returns to step S1507 if the trailing edge of the sheet has not been detected. In step S1508, the CPU 952 determines whether or not a predetermined time period has elapsed since the trailing edge of the sheet was detected. The CPU 952 proceeds to step S1509 (FIG. 15B) if the predetermined time period has elapsed, and returns to step S1508 if the predetermined time period has not elapsed.

In step S1509, the CPU 952 determines the shift direction for the sheet based on the offset amount Z included in the sheet information. If Z is larger than or equal to "0", the CPU 952 determines that the front shift is to be performed and proceeds to step S1510. If Z is smaller than "0", the CPU 952 determines that the back shift is to be performed and proceeds to step S1515. In step S1510, i.e. in the case of the front shift, the CPU 952 drives and rotates the upper tray alignment motor M9 so as to execute the alignment operations by moving the alignment plate 711*a* toward the center of the receiving tray 701 and pressing the sheet P against the stopped alignment plate 711*b* as shown in FIG. 8C. Then, the CPU 952 proceeds to step S1511 and determines whether or not a predetermined time period has elapsed since the alignment plate 711*a* was moved. If the predetermined time period has elapsed, the CPU 952 proceeds to step S1512. If the predetermined time period has not elapsed, the CPU 952 returns to step S1511. In step S1512, the CPU 952 drives and rotates the upper tray alignment motor M9 so as to move the alignment plate 711*a* away from the sheet P in the sheet width direction as shown in FIG. 8D. Then, the CPU 952 proceeds to step S1513 and determines whether or not the sheet to which the alignment process was applied in step S1510 is the last sheet in the job based on the sheet information. The CPU 952 proceeds to step S1525 if the sheet is the last sheet, and to step S1514 if the sheet is not the last sheet. In step S1514, the CPU 952 sets the alignment plate retraction flag to FALSE, and substitutes X1 and X2 into X1_prev and X2_prev, respectively. After storing them in the RAM 954, the CPU 952 ends the processing.

On the other hand, if the CPU 952 determines in step S1509 that the back shift is to be performed, the CPU 952 proceeds to step S1515. In step S1515, the CPU 952 drives and rotates the upper tray alignment motor M10 so as to execute the alignment operations by moving the alignment plate 711*b* toward the center of the receiving tray 701 and pressing the sheet against the stopped alignment plate 711*a*. Then, the CPU 952 proceeds to step S1516 and waits until a predetermined time period elapses since the alignment plate 711*b* was moved. Thereafter, the CPU 952 proceeds to step S1517, and drives and rotates the upper tray alignment motor M10 so as to move the alignment plate 711*b* away from the sheet P in the sheet width direction. The CPU 952 then proceeds to step S1513.

On the other hand, if the CPU 952 determines in step S1505 that the sheet to be conveyed is not the first sheet in the print job and the alignment plates have not been retracted, the CPU 952 proceeds to step S1518. In step S1518, the CPU 952 compares X1 and X2 respectively with X1_prev and X2_prev that are stored in the RAM 954. If X1 is equal to X1_prev and X2 is equal to X2_prev, the sheet to be conveyed will be stacked at the same position as the preceding sheet, and therefore the CPU 952 proceeds to step S1507. Otherwise, the CPU 952 proceeds to step S1519 and changes the waiting positions of the alignment plates 711 in the sheet width direction.

In step S1519, the CPU 952 drives and rotates the alignment plate elevator motor M13 for the upper tray such that, as shown in FIG. 9B, the alignment plates 711*a* and 711*b* are raised off the receiving tray 701 by a predetermined amount. Then, the CPU 952 proceeds to step S1520 and determines whether or not the driving and rotation of the alignment plate elevator motor M13 for the upper tray 701 have finished. If the driving and rotation have finished, the CPU 952 proceeds to step S1521. If the driving has not finished, the CPU 952 returns to step S1520. In step S1521, the CPU 952 drives and rotates the upper tray alignment motors M9 and M10 so as to move the alignment plates 711*a* and 711*b* in the sheet width direction to the alignment waiting positions for the next sheet. Thereafter, the CPU 952 proceeds to step S1522 and determines whether or not the driving and rotation of the upper tray alignment motors M9 and M10 have finished. It should be noted that the processes of steps S1521 and S1522 are controlled based on the sheet edge positions X1 and X2 that were calculated in steps S1503 and S1504, the predetermined retraction amount M described earlier, and the like. If the driving and rotation of the upper tray alignment motors M9 and M10 have finished, the CPU 952 proceeds to step S1523. If the driving has not finished, the CPU 952 returns to step S1522. In step S1523, the CPU 952 drives and rotates the alignment plate elevator motor M13 for the upper tray so as to move the alignment plates 711*a* and 711*b* toward the receiving tray 701 by a predetermined amount as shown in FIG. 9D. Thereafter, the CPU 952 proceeds to step S1507.

After a sheet that has a different size from stacked sheets has been printed, the alignment plates move to and wait at the positions that are suited for the size and the offset of the printed sheet.

On the other hand, if the CPU 952 determines in step S1502 that the sheet to be conveyed is a partition sheet, the CPU 952 proceeds to step S1524 and determines whether or not the alignment plates have been retracted based on the value of the alignment plate retraction flag stored in the RAM 954. The CPU 952 proceeds to step S1526 if it determines that the alignment plates have been retracted, and to step S1525 if it determines otherwise. In step S1525, the CPU 952 drives and rotates the upper tray alignment motors M9 and M10 and the alignment plate elevator motor M13 for the upper tray so as to move the alignment plates 711*a* and 711*b* to the default positions shown in FIG. 8A. Thereafter, the CPU 952 proceeds to step S1526. In step S1526, the CPU 952 sets the alignment plate retraction flag to TRUE, substitutes "0" into each of X1_prev and X2_prev, stores them in the RAM 954, and ends the processing.

As described above, according to the first embodiment, when sheets having a different width from preceding sheets that are already stacked on a receiving tray are to be stacked directly on the preceding sheets, a partition sheet is inserted between the preceding sheets and the sheets having the different width. In this way, when the alignment operations are applied to subsequent sheets, the alignment plates do not come into direct contact with and slide against the front surface of the stacked preceding sheets. Accordingly, a discharge process with a high alignment quality can be continued without interrupting printing, and the usability is improved. The above processes may be executed by storing a program for executing the above processes in the ROM 902 and causing the CPU 901 in the image forming apparatus 10 to execute the stored program. The finisher 500 may be controlled by the execution of the above processes. Also, the image forming apparatus 10 may include a receiving tray, and the above processes may be executed when sheets are discharged onto this receiving tray. The same goes for the embodiments described below.

Although the first embodiment has described the example in which sheets are discharged onto the receiving tray 701, namely the upper tray, the above processes can be executed similarly in the case where sheets are discharged onto the receiving tray 700, namely the lower tray. In this case, the CPU 952 detects the trailing edge of each sheet based on the output from the conveyance sensor 576, and executes the alignment operations by driving and rotating the lower tray alignment motors M11 and M12 and the alignment plate elevator motor M14 for the lower tray.

Second Embodiment

The above first embodiment has described a technique to, when sheets having a different width from preceding sheets are to be stacked directly on the preceding sheets, insert a partition sheet between the preceding sheets and the sheets having the different width so as to prevent stains and the like on the stacked sheets without interrupting a print process. However, if the subsequent sheets have a larger width than the stacked preceding sheets, the alignment process can be executed without the alignment plates sliding against the stacked preceding sheets. In view of this, the second embodiment describes the example in which, if subsequent sheets have a larger width than the stacked preceding sheets, the alignment process is executed without using a partition sheet and without interrupting printing. Note that a configuration of an image forming system according to the second embodiment is the same as the configuration of the image forming system according to the above-described first embodiment, and therefore a description thereof is omitted. In the present second embodiment, only features that are different from the first embodiment are described, and constituent elements having the same configurations as those in the first embodiment are described using the same reference numbers thereas.

Figure 16:
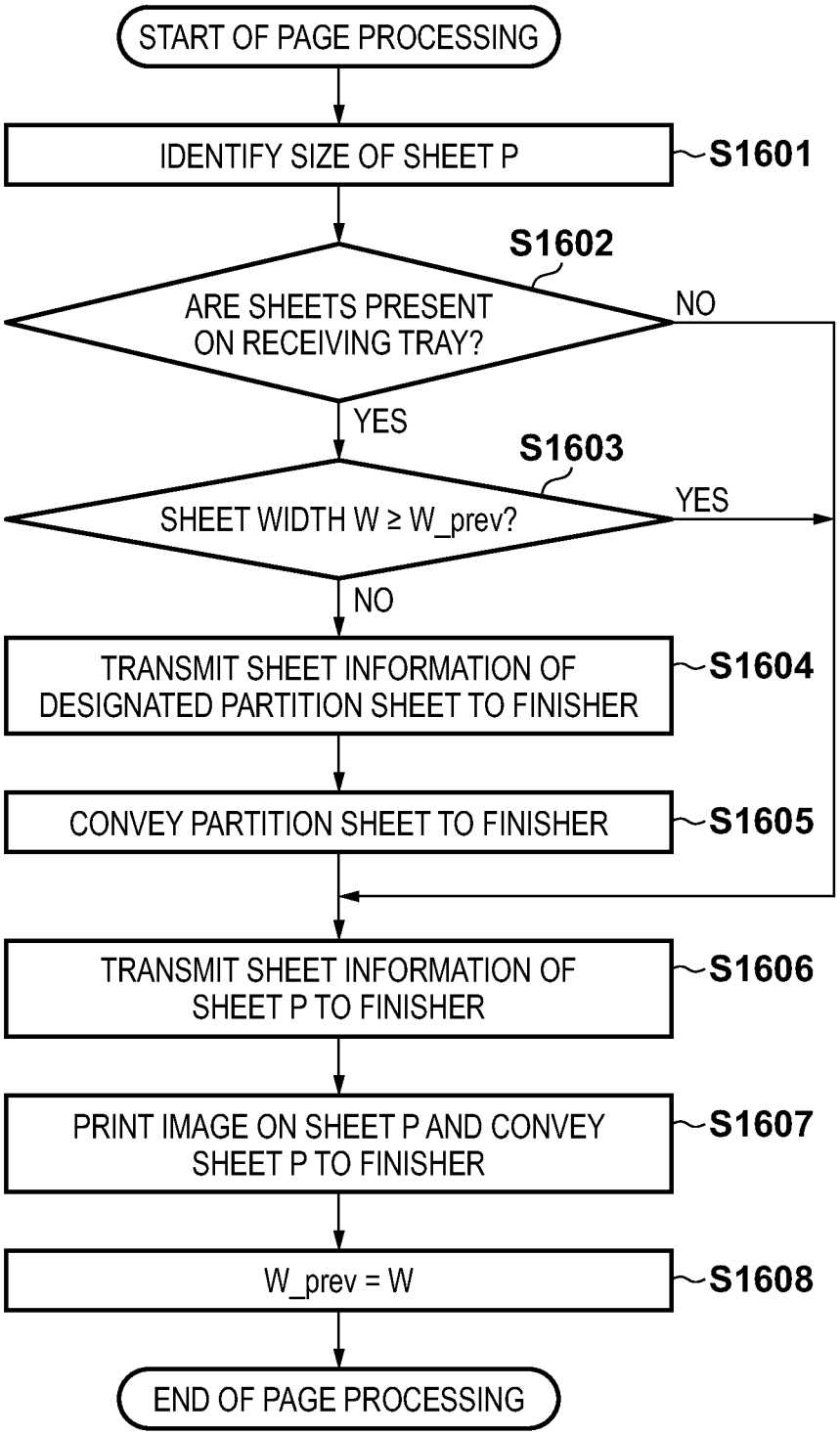
FIG. 16 shows a flowchart for describing processing in which an image forming apparatus according to the second embodiment prints a sheet and discharges the printed sheet to a finisher.

A description is now given of page printing operations executed by the CPU 901 in the CPU circuit unit 900 in the controller according to the second embodiment with reference to a flowchart of FIG. 16.

FIG. 16 shows a flowchart for describing processing in which the image forming apparatus 10 according to the second embodiment prints a sheet and discharges the printed sheet to the finisher. A program for executing this processing is stored in the ROM 902. This processing is realized by the CPU 901 executing the stored program. In this flowchart of FIG. 16, the processes of steps S1601 and S1602 are the same as the processes of steps S1401 and S1402 in the flowchart of FIG. 14, and therefore a description thereof is omitted.

In step S1603, the CPU 901 determines whether or not the sheet width W of a sheet P that was identified in step S1601 is larger than or equal to a variable W_prev that is stored in the memory unit 903 and indicates the sheet width of a preceding sheet. If the CPU 901 determines that the sheet width W of the sheet P is larger than or equal to the variable W_prev, the CPU 901 proceeds to step S1606 without inserting a partition sheet. If the CPU 901 determines otherwise, the CPU 901 proceeds to step S1604. In the flowchart of FIG. 16, the processes of steps S1604 to S1608 are the same as the processes of steps S1404 to S1408 in the flowchart of FIG. 14, and therefore a description thereof is omitted.

Through the above processes according to the second embodiment, only when sheets having a smaller sheet width than preceding sheets that are already stacked on a receiving tray are to be stacked directly on the preceding sheets, a partition sheet is inserted between the preceding sheets and the sheets having the smaller sheet width. On the other hand, when sheets having the same sheet width as or a larger sheet width than sheets that are already stacked on a receiving tray are to be stacked directly on the already-stacked sheets, the alignment process is executed without using a partition sheet and without interrupting printing. In this way, a discharge process with a high alignment quality can be continued without using a partition sheet and without interrupting printing, and the usability is improved. In addition, wasteful use of partition sheets can be restricted.

Third Embodiment

The second embodiment has described the example in which a partition sheet is inserted if subsequent sheets have a smaller width than stacked preceding sheets. However, if the inserted partition sheet has a smaller sheet width than the stacked preceding sheets, the preceding sheets protrude from the partition sheet on a receiving tray. This can lead to the possibility that the quality of an image on the topmost sheet of the stacked sheets may be reduced because the alignment plates still slide against the front surface of the topmost sheet.

In view of this, the third embodiment describes the example in which the user is warned if the partition sheet has a smaller sheet width than the stacked sheets. Note that a configuration of an image forming system according to the third embodiment is the same as the configuration of the image forming system according to the above-described first embodiment, and therefore a description thereof is omitted. In the third embodiment, only features that are different from the above-described embodiments are described, and constituent elements having the same configurations as those in the above-described embodiments are described using the same reference numbers thereas.

Figure 17:
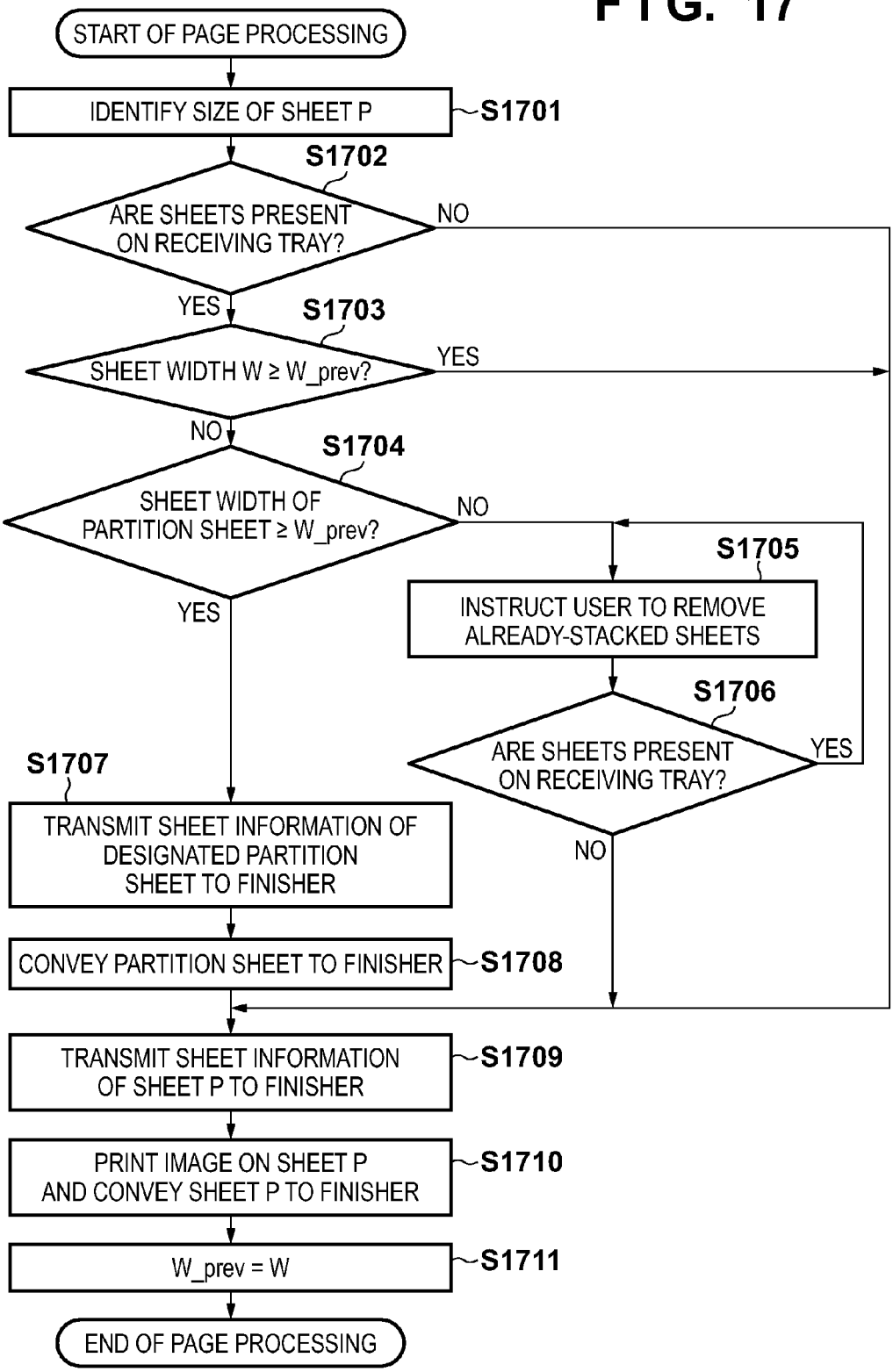
FIG. 17 shows a flowchart for describing processing in which an image forming apparatus according to the third embodiment prints a sheet and discharges the printed sheet to a finisher.

The following describes page printing operations executed by the CPU 901 in the CPU circuit unit 900 in the controller of the image forming apparatus 10 according to the third embodiment with reference to a flowchart of FIG. 17.

FIG. 17 shows a flowchart for describing processing in which the image forming apparatus 10 according to the third embodiment prints a sheet and discharges the printed sheet to the finisher. A program for executing this processing is stored in the ROM 902. This processing is realized by the CPU 901 executing the stored program. In the flowchart of FIG. 17, the processes of steps S1701 to S1703 are the same as the processes of steps S1601 to S1603 in the flowchart of FIG. 16, and therefore a description thereof is omitted.

In step S1704, the CPU 901 determines whether or not the sheet width of a partition sheet that was designated on the screen shown in FIG. 13C is larger than or equal to a variable W_prev that is stored in the memory unit 903 and indicates the sheet width of a preceding sheet. If the CPU 901 determines that the sheet width of the partition sheet is larger than or equal to the sheet width of the preceding sheet, the CPU 901 proceeds to step S1707 to insert the partition sheet. If the CPU 901 determines otherwise, the CPU 901 proceeds to step S1705. In step S1705, as the sheet width of the partition sheet is smaller than the sheet width of the preceding sheet, the CPU 901 causes the console unit controller 941 to display a message shown in FIG. 18 on the display unit 420, and proceeds to step S1706.

Figure 18:
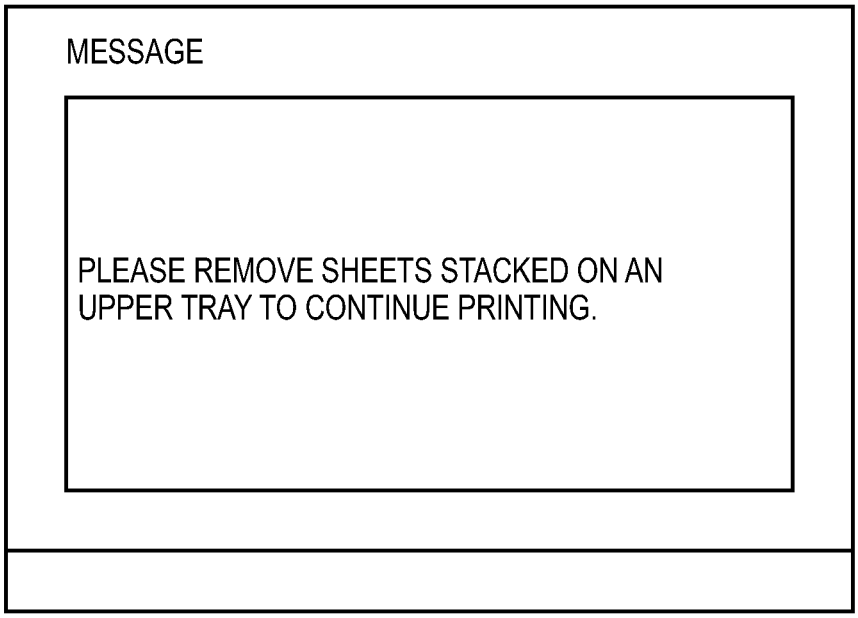
FIG. 18 depicts a view illustrating an example of a warning screen according to the third embodiment for the case where a partition sheet has a smaller width than a preceding sheet and therefore there is a possibility that the front surface of the preceding sheet may be stained by alignment plates.

FIG. 18 shows an example of a warning screen according to the third embodiment for the case where the partition sheet has a smaller width than that of the preceding sheet and therefore there is a possibility that the front surface of the preceding sheet may be stained by the alignment plates. Specifically, this screen presents warning that sheets stacked on the upper tray need to be removed to continue printing in the case where a sheet P is to be discharged onto the upper tray.

After proceeding to step S1706, the CPU 901 determines whether or not sheets are placed on the receiving tray onto which the printed sheet P is to be discharged based on the input from the sheet sensor 730 (or the sheet sensor 731 in the case of the lower tray 700). If the CPU 901 determines that sheets are placed on the receiving tray onto which the sheet P is to be discharged, the CPU 901 returns to step S1705. If the CPU 901 determines that no sheet is placed on the upper tray 701 based on the sheet sensor 730, the CPU 901 proceeds to step S1709. In the flowchart of FIG. 17, the processes of steps S1707 to S1711 are the same as the processes of steps S1604 to S1608 in the flowchart of FIG. 16, and therefore a description thereof is omitted.

As described above, according to the third embodiment, when sheets having the same sheet width as or a larger sheet width than sheets that are already stacked on a receiving tray are to be stacked directly on the already-stacked sheets, the alignment process is executed without using a partition sheet and without interrupting printing. On the other hand, when sheets having a smaller sheet width than preceding sheets that are already stacked on the receiving tray are to be stacked directly on the preceding sheets, a partition sheet is inserted between the preceding sheets and the sheets having the smaller sheet width if the sheet width of the partition sheet is larger than or equal to the sheet width of the preceding sheets. If the sheet width of the partition sheet is smaller than the sheet width of the preceding sheets, the print process is interrupted, and a message for guiding the user to remove the stacked sheets from the tray is displayed to the user.

That is to say, when there is a possibility that the alignment process may reduce the image quality of the already-stacked sheets, a partition sheet is inserted. This makes it possible to obtain the effect of preventing reduction in the image quality of the already-stacked sheets and avoiding the interruption of printing. If the reduction in the image quality of the already-stacked sheets cannot be prevented even by the insertion of the partition sheet, necessary processes can be executed by interrupting printing through presentation of warning to the user.

Fourth Embodiment

The above third embodiment has described the example in which a partition sheet is inserted when sheets having a smaller sheet width than that of preceding sheets that are already stacked are to be stacked directly on the preceding sheets and the sheet width of the partition sheet is larger than or equal to the sheet width of the preceding sheets. This makes it possible to continue a discharge process with a high alignment quality without interrupting printing. However, in some cases, a partition sheet is inserted in the middle of a job. In such cases, in order to complete printed materials of one job as finished products after they have been discharged, it is necessary to remove the partition sheet from those printed materials.

In view of this, the fourth embodiment describes the example in which a partition sheet is inserted only between different jobs. Note that a configuration of an image forming system according to the fourth embodiment is the same as the configuration of the image forming system according to the above-described first embodiment, and therefore a description thereof is omitted. In the fourth embodiment, only features that are different from the third embodiment are described, and constituent elements having the same configurations as those in the third embodiment are described using the same reference numbers thereas.

Figure 19:
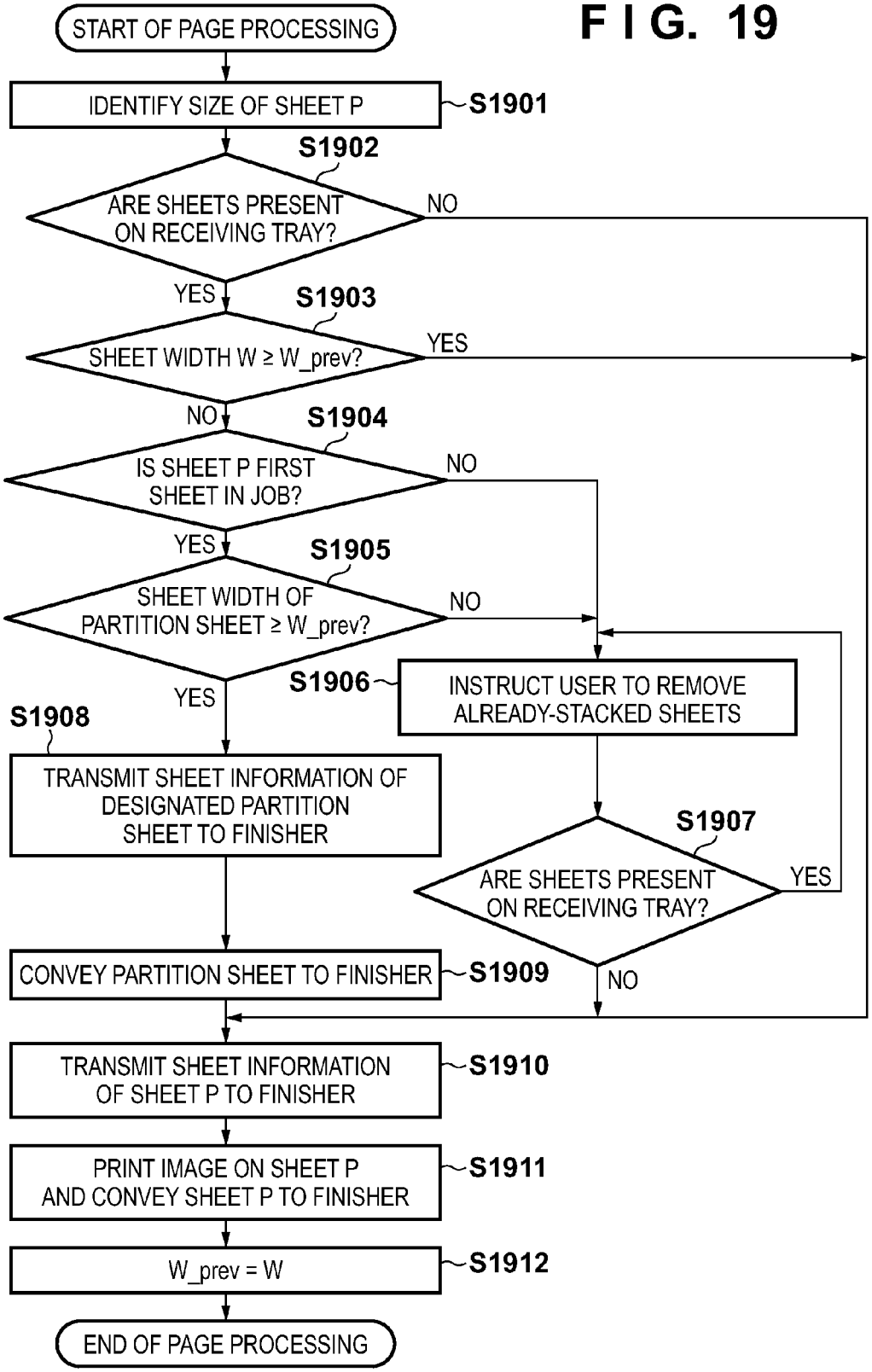
FIG. 19 shows a flowchart for describing processing in which an image forming apparatus according to the fourth embodiment prints a sheet and discharges the printed sheet to a finisher.

The following describes page printing operations executed by the CPU 901 in the CPU circuit unit 900 in the controller of the image forming apparatus according to the fourth embodiment with reference to a flowchart of FIG. 19.

FIG. 19 shows a flowchart for describing processing in which the image forming apparatus 10 according to the fourth embodiment prints a sheet and discharges the printed sheet to the finisher. A program for executing this processing is stored in the ROM 902. This processing is realized by the CPU 901 executing the stored program. In the flowchart of FIG. 19, the processes of steps S1901 to S1903 are the same as the processes of steps S1701 to S1703 in the flowchart of FIG. 17, and therefore a description thereof is omitted.

In step S1904, the CPU 901 determines whether or not a sheet P that was identified in step S1901 is the first sheet in the job. The CPU 901 proceeds to step S1905 if it determines that the sheet P is the first sheet in the job, and to step S1906 if it determines otherwise. In the flowchart of FIG. 19, the processes of steps S1905 to S1912 are the same as the processes of steps S1704 to S1711 in the flowchart of FIG. 17, and therefore a description thereof is omitted.

According to the above-descried fourth embodiment, when a printed sheet having a smaller sheet width than that of preceding sheets that are already stacked on a receiving tray is to be stacked directly on the already-stacked sheets, if the printed sheet is not the first sheet in the job, the print process is interrupted, and a message for instructing the removal of the already-stacked sheets on the receiving tray is displayed in step S1906. On the other hand, when a printed sheet having a smaller sheet width than preceding sheets that are already stacked on a receiving tray is to be stacked directly on the already-stacked sheets, if the printed sheet is the first sheet in the job and the sheet width of the partition sheet is larger than or equal to the sheet width of the preceding sheets, the partition sheet is inserted between the stacked preceding sheets and the printed sheet. If the sheet width of the partition sheet is smaller than the sheet width of the preceding sheets, the print process is interrupted, and a message for guiding the user to remove the preceding sheets stacked on the receiving tray is displayed to the user.

This not only makes it possible to obtain the effect of the first to third embodiments described above, but also prevents a partition sheet from being inserted into printed materials of one job. Accordingly, even when a partition sheet is used, it is not necessary to remove the partition sheet from printed materials of one job.

Fifth Embodiment

In a system that has a mechanism for counting the number of discharged sheets and charging the user in accordance with the counted number, partition sheets are also counted, and therefore there is a possibility of charging the user an inappropriate fee. In view of this, the fifth embodiment describes an example of an image forming system that does not count partition sheets. Note that a configuration of the image forming system according to the fifth embodiment is the same as the configuration of the image forming system according to the above-described first embodiment, and therefore a description thereof is omitted. In the fifth embodiment, only features that are different from the fourth embodiment are described, and constituent elements having the same configurations as those in the fourth embodiment are described using the same reference numbers thereas.

When the CPU 952 in the finisher controller 951 in the finisher 500 according to the fifth embodiment detects the trailing edge of a sheet based on the output from the sheet sensor 574 or 576, the CPU 952 notifies the CPU circuit unit 900 in the controller in the image forming apparatus 10 of the discharge of the sheet. When the CPU 901 is notified of the discharge, the CPU 901 increments a counter memory stored in the memory unit 903. Information of the counter memory stored in the memory unit 903 is stored in a non-volatile memory so that the counted value thereof can be held even when the power of the image forming apparatus 10 is off.

Figure 20A:
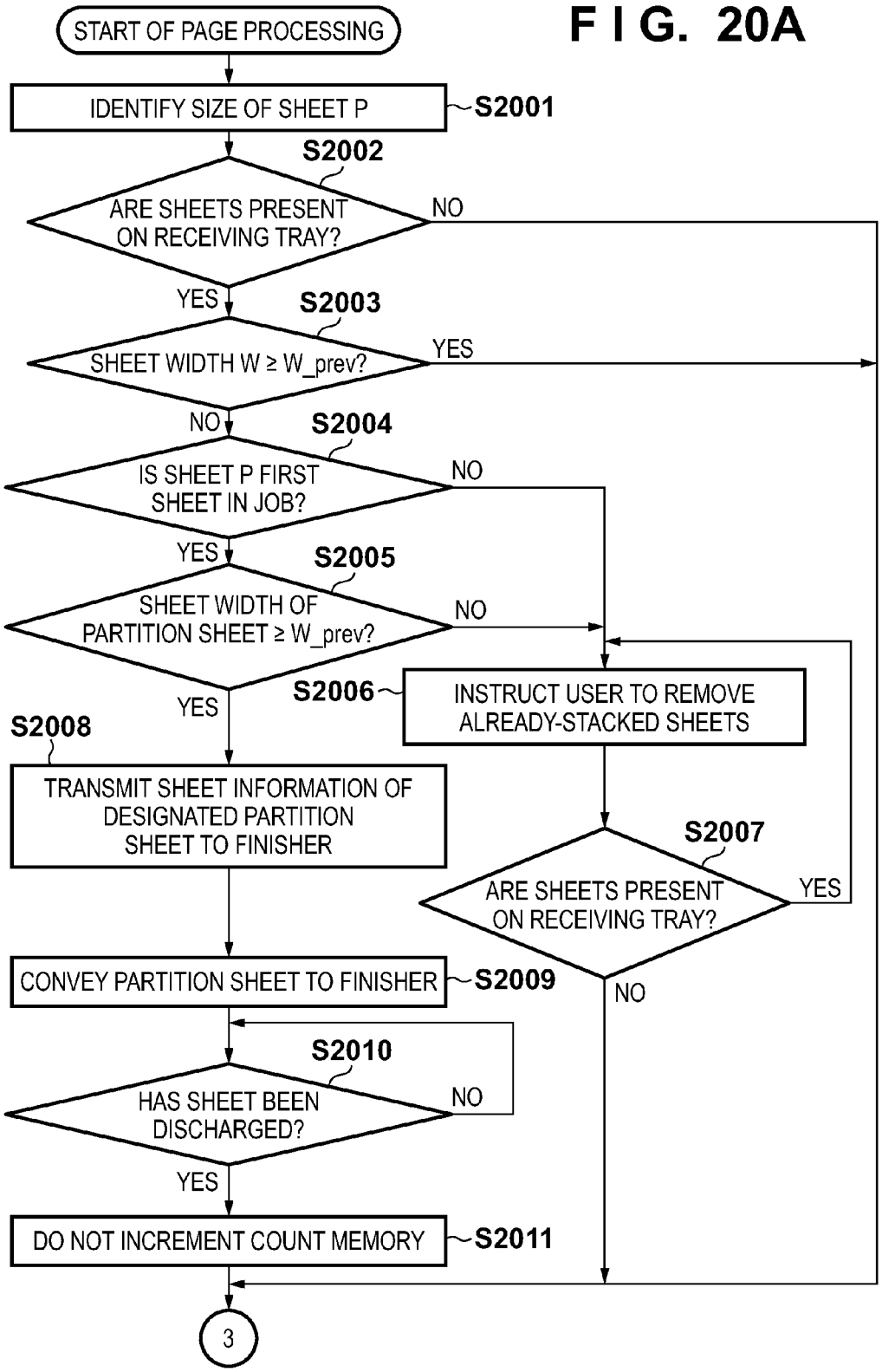
FIGS. 20A and 20B show flowcharts for describing processing in which an image forming apparatus according to the fifth embodiment prints a sheet and discharges the printed sheet to a finisher.
Figure 20B:
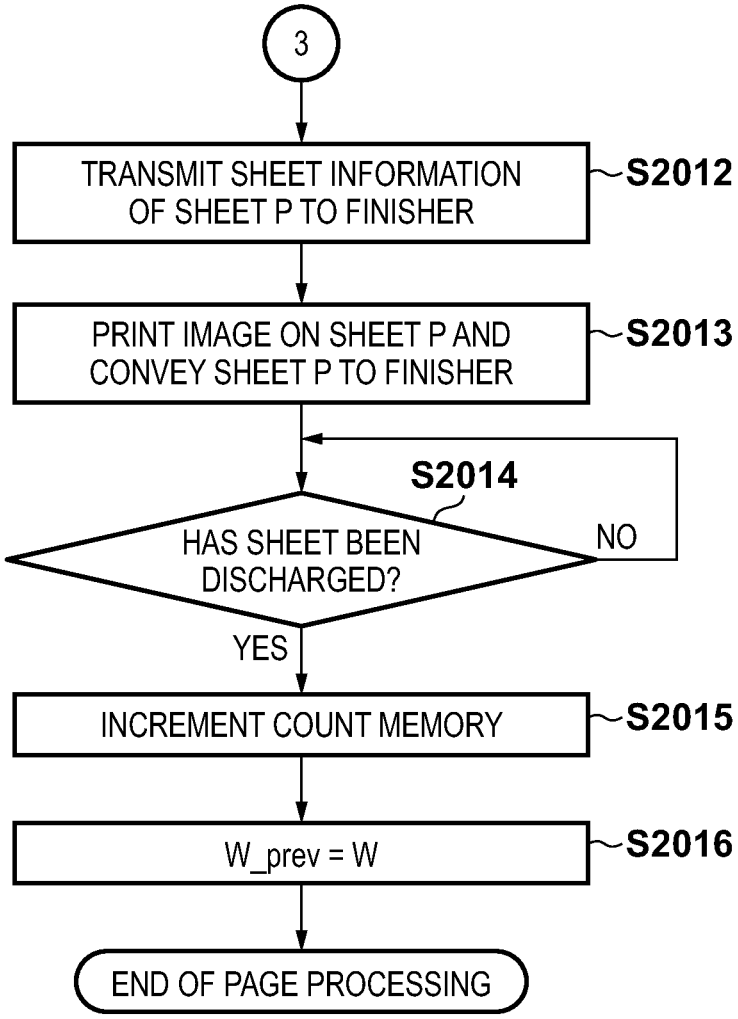
Figure 21:
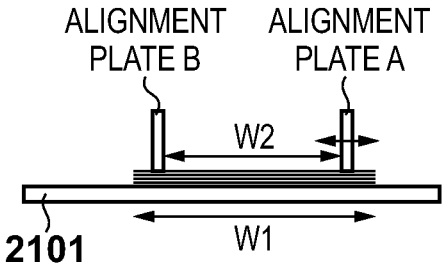
FIG. 21 is a diagram for describing alignment operations executed when a plurality of sheets having different sheet widths are stacked.

The following describes page printing operations executed by the CPU 901 in the CPU circuit unit 900 in the controller of the image forming apparatus 10 according to the fifth embodiment with reference to the flowcharts of FIGS. 20A and 20B.

FIGS. 20A and 20B show flowcharts for describing processing in which the image forming apparatus 10 according to the fifth embodiment prints a sheet and discharges the printed sheet to the finisher. A program for executing this processing is stored in the ROM 902. This processing is realized by the CPU 901 executing the stored program. In the flowchart of FIG. 20A, the processes of steps S2001 to S2009 are the same as the processes of steps S1901 to S1909 in the flowchart of FIG. 19, and therefore a description thereof is omitted.

After conveying a partition sheet to the finisher 500 in step S2009, the CPU 901 proceeds to step S2010 and determines whether or not the partition sheet has been discharged based on the output from the sheet sensor 574 or 576. The CPU 901 proceeds to step S2011 if it determines that the partition sheet has been discharged, and returns to step S2010 if it determines otherwise. The CPU 901 skips an incrementing process in step S2011 and proceeds to step S2012 (FIG. 20B). In the flowchart of FIG. 20B, the processes of steps S2012 and S2013 are the same as the processes of steps S1910 and S1911 in the flowchart of FIG. 19, and therefore a description thereof is omitted.

After conveying the sheet P to the finisher 500 in step S2013, the CPU 901 proceeds to step S2014 and determines whether or not the sheet P has been discharged based on the output from the conveyance sensor 574 or 576. The CPU 901 proceeds to step S2015 if it determines that the sheet P has been discharged, and returns to step S2014 if it determines otherwise. The CPU 901 increments the counter memory stored in the memory unit 903 in step S2015, and proceeds to step S2016. In the flowchart of FIG. 20B, the process of step S2016 is the same as the process of step S1912 in the flowchart of FIG. 19, and therefore a description thereof is omitted.

As described above, according to the fifth embodiment, the incrementing process is not executed if a conveyed sheet is a partition sheet. This makes it possible to prevent the user from being charged an inappropriate fee, thus improving the usability.

Other Embodiments

The above first to fifth embodiments have described the example in which whether or not a partition sheet should be inserted is controlled based on the difference between the width of printed sheets that are already stacked on a receiving tray and the width of a printed sheet that is to be conveyed and stacked. However, the present invention is not limited in this way. Alternatively, whether or not a partition sheet should be inserted may be controlled based on information of the size of printed sheets that are already stacked on the receiving tray and on information of the size of a sheet to be printed. For example, control may be performed to insert the partition sheet when the printed sheets that are already stacked on the receiving tray have an A4R size and the sheet to be printed has an A4 size.

In the first to fifth embodiments described above, the user selects a partition sheet in advance using the screens shown in FIGS. 13A to 13C. Alternatively, the CPU 901 may automatically select a partition sheet in accordance with the size of preceding sheets. For example, the CPU 901 may select a partition sheet that has a larger width (size) than the already-stacked sheets. This can suppress the occurrence of the problem described in the third embodiment.

Furthermore, the use of partition sheets may be restricted in accordance with sheet attributes such as a size, a color, and a basis weight. For example, only sheets that have a basis weight of 100 g/m$^2$ may be selectable as partition sheets.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (for example, computer-readable medium.

While the present invention has been described with reference to exemplary embodiments, it is to be understood that the invention is not limited to the disclosed exemplary embodiments. The scope of the following claims is to be accorded the broadest interpretation so as to encompass all such changes and equivalent structures and functions.

This application claims the benefit of Japanese Patent Application No. 2012-244806, filed Nov. 6, 2012, which is hereby incorporated by reference herein in its entirety.

What is claimed is:

1. A sheet processing apparatus comprising:

a discharge control unit configured to control to discharge a sheet on a stacking unit;

an alignment unit configured to align sheets stacked on the stacking unit by causing a first alignment member and a second alignment member to come into contact with edges of a sheet stacked on the stacking unit in a sheet width direction; and a control unit configured to perform control to, in a case that a second sheet that has a different sheet width from a sheet width of a first sheet stacked on the stacking unit is to be stacked on the first sheet and aligned by the alignment unit, separate between the first sheet and the second sheet by discharging a partition sheet onto the first sheet stacked on the stacking unit.

2. The sheet processing apparatus according to claim 1, wherein the control unit discharges the partition sheet onto the first sheet stacked on the stacking unit, in a case that a print job in which the first sheet is printed is different from a print job in which the second sheet is printed, and does not discharge the partition sheet onto the first sheet stacked on the stacking unit, in a case that the first sheet and the second sheet are printed in a same print job.

3. The sheet processing apparatus according to claim 1, wherein the partition sheet has a predetermined sheet attribute including any one of a size, a color, and a basis weight.

4. The sheet processing apparatus according to claim 1, further comprising:

a count unit configured to count the number of sheets stacked on the stacking unit to be charged for, wherein the count unit excludes the partition sheet from counting.

5. A sheet processing apparatus comprising:

a discharge control unit configured to control to discharge a sheet on a stacking unit;

an alignment unit configured to align sheets stacked on the stacking unit by causing a first alignment member and a second alignment member to come into contact with edges of a sheet stacked on the stacking unit in a sheet width direction; and a control unit configured to perform control to, in a case that a second sheet that has a smaller sheet width than a sheet width of a first sheet stacked on the stacking unit is to be stacked on the first sheet and aligned by the alignment unit, the control unit performs control to separate between the first sheet and the second sheet by discharging the partition sheet onto the first sheet stacked on the stacking unit.

6. The sheet processing apparatus according to claim 5, wherein in a case that the second sheet has a larger sheet width than a sheet width of the first sheet, the control unit does not discharge the partition sheet onto the first sheet stacked on the stacking unit.

7. The sheet processing apparatus according to claim 5, further comprising:

a warning unit configured to warn a user in a case that the partition sheet has a smaller sheet width than a sheet width of the first sheet.

8. A method of controlling a sheet processing apparatus, comprising:

controlling to discharge a sheet on a stacking unit;

aligning sheets stacked on the stacking unit by causing a first alignment member and a second alignment member to come into contact with edges of a sheet stacked on the stacking unit in a sheet width direction; and performing control to, in a case that a second sheet that has a different sheet width from a sheet width of a first sheet stacked on the stacking unit is to be stacked on the first sheet and aligned, discharge a partition sheet onto the first sheet stacked on the stacking unit.

9. A non-transitory storage medium having stored therein a program for causing a computer to execute the method according to claim 8.

10. A method of controlling a sheet processing apparatus, comprising:

controlling to discharge a sheet on a stacking unit;

aligning sheets stacked on the stacking unit by causing a first alignment member and a second alignment member to come into contact with edges of a sheet stacked on the stacking unit in a sheet width direction; and performing control to, in a case that a second sheet that has a smaller sheet width than a sheet width of a first sheet stacked on the stacking unit is to be stacked on the first sheet and aligned, discharge a partition sheet onto the first sheet stacked on the stacking unit.

11. A non-transitory storage medium having stored therein a program for causing a computer to execute the method according to claim 10.

* * * * *